US011109177B2

(12) United States Patent
Mindlin et al.

(10) Patent No.: US 11,109,177 B2
(45) **Date of Patent: *Aug. 31, 2021**

(54) METHODS AND SYSTEMS FOR SIMULATING ACOUSTICS OF AN EXTENDED REALITY WORLD

(71) Applicant: Verizon Patent and Licensing Inc., Basking Ridge, NJ (US)

(72) Inventors: Samuel Charles Mindlin, Brooklyn, NY (US); Kunal Jathal, Los Angeles, CA (US)

(73) Assignee: Verizon Pstent and Licensing Inc., Basking Ridge, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/934,651

(22) Filed: Jul. 21, 2020

(65) Prior Publication Data

US 2021/0112361 A1 Apr. 15, 2021

Related U.S. Application Data

(63) Continuation of application No. 16/599,958, filed on Oct. 11, 2019, now Pat. No. 10,757,528.

(51) Int. Cl.

| | |
|---|---|
| ***H04S 7/00*** | (2006.01) |
| ***H04R 5/00*** | (2006.01) |
| ***H04S 3/00*** | (2006.01) |
| ***H04R 3/00*** | (2006.01) |
| ***H04R 5/027*** | (2006.01) |

(52) U.S. Cl.
CPC ..... *H04S 7/303* (2013.01); *H04R 5/027* (2013.01); *H04S 3/008* (2013.01); *H04S 2400/01* (2013.01); *H04S 2400/11* (2013.01); *H04S 2400/15* (2013.01)

(58) Field of Classification Search
CPC . H04S 3/008; H04S 5/005; H04S 7/00; H04S 7/30; H04S 7/302; H04S 7/303; H04S 7/304; H04S 7/305; H04S 7/306; H04S 2400/01; H04S 2400/11; H04S 2400/15; H04S 2420/01; G06F 3/01; G06F 3/001; G06F 3/012; G06F 3/16; H04N 7/15; H04N 7/157; H04R 5/00; H04R 5/027; H04R 3/00
See application file for complete search history.

(56) References Cited

U.S. PATENT DOCUMENTS 5,526,429 A * 6/1996 Inanaga ..... H04S 7/304 385/25
5,761,314 A * 6/1998 Inanaga ..... H04R 5/033 381/17
6,111,962 A * 8/2000 Akio ..... G10H 1/0091 381/104
9,197,977 B2 * 11/2015 Mahabub ..... H04S 7/30
(Continued)

*Primary Examiner* — Thang V Tran

(57) ABSTRACT

An exemplary acoustics simulation system selects, from an impulse response library, an impulse response that corresponds to a subspace of an extended reality world. Based on the selected impulse response, the acoustics simulation system generates audio data customized to the subspace of the extended reality world. Additionally, the acoustics simulation system provides the generated audio data for simulating acoustics of the extended reality world as part of a presentation of the extended reality world. Corresponding methods and systems are also disclosed.

20 Claims, 11 Drawing Sheets

(56) References Cited

U.S. PATENT DOCUMENTS

| | | | | |
|---|---|---|---|---|
| 9,522,330 | B2 * | 12/2016 | Pile | A63F 13/428 |
| 10,062,208 | B2 | 8/2018 | Ziman | |
| 10,206,055 | B1 | 2/2019 | Mindlin et al. | |
| 10,297,981 | B2 | 5/2019 | Bovington et al. | |
| 10,484,811 | B1 | 11/2019 | Mindlin et al. | |
| 10,516,959 | B1 | 12/2019 | Mindlin et al. | |
| 10,705,790 | B2 * | 7/2020 | Dantrey | G06F 3/167 |
| 10,757,528 | B1 * | 8/2020 | Mindlin | H04R 5/027 |
| 10,820,135 | B2 * | 10/2020 | Boerum | H04S 7/304 |
| 2009/0066690 | A1 | 3/2009 | Harrison | |
| 2010/0119075 | A1 * | 5/2010 | Xiang | H04S 7/30 381/63 |
| 2014/0368543 | A1 | 12/2014 | Hamilton et al. | |
| 2015/0331666 | A1 | 11/2015 | Bucsa et al. | |
| 2016/0313790 | A1 | 10/2016 | Clement et al. | |
| 2017/0045941 | A1 | 2/2017 | Tokubo et al. | |
| 2018/0181367 | A1 | 6/2018 | Goi | |
| 2019/0099678 | A1 | 4/2019 | Khan et al. | |
| 2019/0385613 | A1 | 12/2019 | Mindlin et al. | |

* cited by examiner

412

| IMPULSE RESPONSE LIBRARY | | |
|---|---|---|
| INDEXING | | IMPULSE RESPONSE DATA |
| ListenerLocation_01 | SourceLocation_01 | ImpulseResponse_01_01 |
| ListenerLocation_01 | SourceLocation_02 | ImpulseResponse_01_02 |
| ListenerLocation_01 | SourceLocation_03 | ImpulseResponse_01_03 |
| ListenerLocation_01 | SourceLocation_04 | ImpulseResponse_01_04 |
| . . . | . . . | . . . |
| ListenerLocation_02 | SourceLocation_01 | ImpulseResponse_02_01 |
| ListenerLocation_02 | SourceLocation_02 | ImpulseResponse_02_02 |
| ListenerLocation_02 | SourceLocation_03 | ImpulseResponse_02_03 |
| ListenerLocation_02 | SourceLocation_04 | ImpulseResponse_02_04 |
| . . . | . . . | . . . |
| ListenerLocation_03 | SourceLocation_01 | ImpulseResponse_03_01 |
| ListenerLocation_03 | SourceLocation_02 | ImpulseResponse_03_02 |
| ListenerLocation_03 | SourceLocation_03 | ImpulseResponse_03_03 |
| ListenerLocation_03 | SourceLocation_04 | ImpulseResponse_03_04 |
| . . . | . . . | . . . |
| ListenerLocation_04 | SourceLocation_01 | ImpulseResponse_04_01 |
| ListenerLocation_04 | SourceLocation_02 | ImpulseResponse_04_02 |
| ListenerLocation_04 | SourceLocation_03 | ImpulseResponse_04_03 |
| ListenerLocation_04 | SourceLocation_04 | ImpulseResponse_04_04 |
| . . . | . . . | . . . |
| ListenerLocation_M | SourceLocation_N | ImpulseResponse_M_N |

Fig. 6

METHODS AND SYSTEMS FOR SIMULATING ACOUSTICS OF AN EXTENDED REALITY WORLD

RELATED APPLICATIONS

This application is a continuation application of U.S. patent application Ser. No. 16/599,958, filed Oct. 11, 2019, and entitled "Methods and Systems for Simulating Spatially-Varying Acoustics of an Extended Reality World," which is hereby incorporated by reference in its entirety.

BACKGROUND INFORMATION

Audio signal processing techniques such as convolution reverb are used for simulating acoustic properties (e.g., reverberation, etc.) of a physical or virtual 3D space from a particular location within the 3D space. For example, an impulse response can be recorded at the particular location and mathematically applied to (e.g., convolved with) audio signals to simulate a scenario in which the audio signal originates within the 3D space and is perceived by a listener as having the acoustic characteristics of the particular location. In one use case, for instance, a convolution reverb technique could be used to add realism to sound created for a special effect in a movie.

In this type of conventional example (i.e., the movie special effect mentioned above), the particular location of a listener may be well-defined and predetermined before the convolution reverb effect is applied and presented to a listener. For instance, the particular location at which the impulse response is to be recorded may be defined, during production of the movie (long before the movie is released), as a vantage point of the movie camera within the 3D space.

While such audio processing techniques could similarly benefit other exemplary use cases such as extended reality (e.g., virtual reality, augmented reality, mixed reality, etc.) use cases, additional complexities and challenges arise for such use cases that are not well accounted for by conventional techniques. For example, the location of a user in an extended reality use case may continuously and dynamically change as the extended reality user freely moves about in a physical or virtual 3D space of an extended reality world. Moreover, these changes to the user location may occur at the same time that extended reality content, including sound, is being presented to the user.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

FIG. 6 illustrates an exemplary impulse response library that includes a plurality of different impulse responses each corresponding to a different subspace of the extended reality world according to embodiments described herein.

DETAILED DESCRIPTION OF PREFERRED EMBODIMENTS

Figure 1:
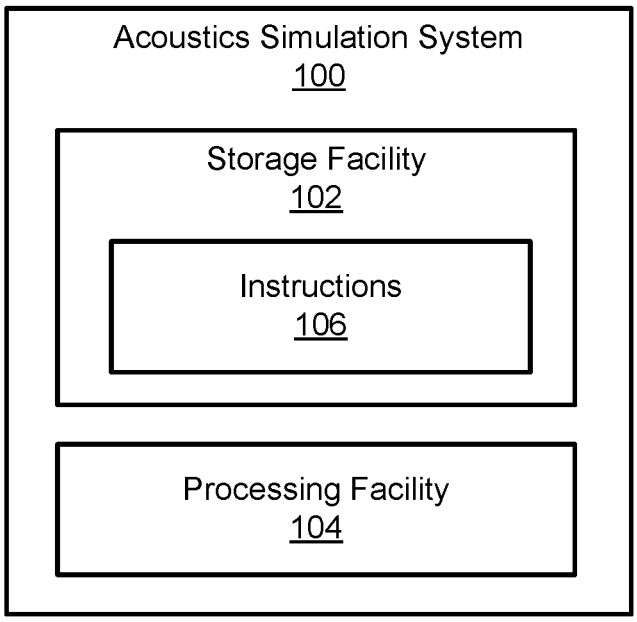
FIG. 1 illustrates an exemplary acoustics simulation system for simulating spatially-varying acoustics of an extended reality world according to embodiments described herein.

Methods and systems for simulating spatially-varying acoustics of an extended reality world are described herein. Given an acoustic environment such as a particular room having particular characteristics (e.g., having a particular shape and size, having particular objects such as furnishings included therein, having walls and floors and ceilings composed of particular materials, etc.), the acoustics affecting sound experienced by a listener in the room may vary from location to location within the room. For instance, given an acoustic environment such as the interior of a large cathedral, the acoustics of sound propagating in the cathedral may vary according to where the listener is located within the cathedral (e.g., in the center versus near a particular wall, etc.), where one or more sound sources are located within the cathedral, and so forth. Such variation of the acoustics of a 3D space from location to location within the space will be referred to herein as spatially-varying acoustics.

As mentioned above, convolution reverb and other such techniques may be used for simulating acoustic properties (e.g., reverberation, acoustic reflection, acoustic absorption, etc.) of a particular space from a particular location within the space. However, whereas traditional convolution reverb techniques are associated only with one particular location in the space, methods and systems for simulating spatially-varying acoustics described herein properly simulate the acoustics even as the listener and/or sound sources move around within the space. For example, if an extended reality world includes an extended reality representation of the large cathedral mentioned in the example above, a user experiencing the extended reality world may move freely about the cathedral (e.g., by way of an avatar) and sound presented to the user will be simulated, using the methods and systems described herein, to acoustically model the cathedral for wherever the user and any sound sources in the room are located from moment to moment. This simulation of the spatially-varying acoustics of the extended reality world may be performed in real time even as the user and/or various sound sources move arbitrarily and unpredictably through the extended reality world.

To simulate spatially-varying acoustics of an extended reality world in these ways, an exemplary acoustics simulation system may be configured, in one particular embodiment, to identify a location within an extended reality world of an avatar of a user who is using a media player device to experience (e.g., via the avatar) the extended reality world from the identified location. The acoustics simulation system may select an impulse response from an impulse response library that includes a plurality of different impulse responses each corresponding to a different subspace of the extended reality world. The impulse response that the acoustics simulation system selects from the impulse response library may correspond to a particular subspace of the different subspaces of the extended reality world. For example, the particular subspace may be a subspace associated with the identified location of the avatar. Based on the selected impulse response, the acoustics simulation system may generate an audio stream associated with the identified location of the avatar. For instance, the audio stream may be configured, when rendered by the media player device, to present sound to the user in accordance with simulated acoustics customized to the identified location of the avatar within the extended reality world.

In certain implementations, the acoustics simulation system may be configured to perform the above operations and/or other related operations in real time so as to provide spatially-varying acoustics simulation of an extended reality world to an extended reality user as the pose of the user (i.e., the location of the user within the extended reality world, the orientation of the user's ears as he or she looks around within the extended reality world, etc.) dynamically changes during the extended reality experience. To this end, the acoustics simulation system may be implemented, in certain examples, by a multi-access edge compute ("MEC") server associated with a provider network providing network service to the media player device used by the user. The acoustics simulation system implemented by the MEC server may identify a location within the extended reality world of the avatar of the user as the user uses the media player device to experience the extended reality world from the identified location via the avatar. The acoustics simulation system implemented by the MEC server may also select, from the impulse response library including the plurality of different impulse responses that each correspond to a different subspace of the extended reality world, the impulse response that corresponds to the particular subspace associated with the identified location.

In addition to these operations that were described above, the acoustics simulation system implemented by the MEC server may be well adapted (e.g., due to the powerful computing resources that the MEC server and provider network may make available with a minimal latency) to receive and respond practically instantaneously (as perceived by the user) to acoustic propagation data representative of decisions made by the user. For instance, as the user causes the avatar to move from location to location or to turn its head to look in one direction or another, the acoustics simulation system implemented by the MEC server may receive, from the media player device, acoustic propagation data indicative of an orientation of a head of the avatar and/or other relevant data representing how sound is to propagate through the world before arriving at the virtual ears of the avatar. Based on both the selected impulse response and the acoustic propagation data indicative of the orientation of the head, the acoustics simulation system implemented by the MEC server may generate an audio stream that is to be presented to the user. For example, the audio stream may be configured, when rendered by the media player device, to present sound to the user in accordance with simulated acoustics customized to the identified location of the avatar within the extended reality world. As such, the acoustics simulation system implemented by the MEC server may provide the generated audio stream to the media player device for presentation by the media player device to the user.

Methods and systems described herein for simulating spatially-varying acoustics of an extended reality world may provide and be associated with various advantages and benefits. For example, when acoustics of a particular space in an extended reality world are simulated, an extended reality experience of a particular user in that space may be made considerably more immersive and enjoyable than if the acoustics were not simulated. However, merely simulating the acoustics of a space without regard for how the acoustics vary from location to location within the space (as may be done by conventional acoustics simulation techniques) may still leave room for improvement. Specifically, the realism and immersiveness of an experience may be lessened if a user moves around an extended reality space and does not perceive (e.g., either consciously or subconsciously) natural acoustical changes that the user would expect to hear in the real world.

It is thus an advantage and benefit of the methods and systems described herein that the acoustics of a room are simulated to vary dynamically as the user moves about the extended reality world. Moreover, as will be described in more detail below, because each impulse response used for each subspace of the extended reality world may be a spherical impulse response that accounts for sound coming from all directions, sound may be realistically simulated not only from a single fixed orientation at each different location in the extended reality world, but from any possible orientation at each location. Accordingly, not only is audio presented to the user accurate with respect to the location where the user has moved his or her avatar within the extended reality world, but the audio is also simulated to account for the direction that the user is looking within the extended reality world as the user causes his or her avatar to turn its head in various directions without limitation. In all of these ways, the methods and systems described herein may contribute to highly immersive, enjoyable, and acoustically-accurate extended reality experiences for users.

Various embodiments will now be described in more detail with reference to the figures. The disclosed systems and methods may provide one or more of the benefits mentioned above and/or various additional and/or alternative benefits that will be made apparent herein.

FIG. 1 illustrates an exemplary acoustics simulation system 100 ("system 100") for simulating spatially-varying acoustics of an extended reality world. As shown, system 100 may include, without limitation, a storage facility 102 and a processing facility 104 selectively and communicatively coupled to one another. Facilities 102 and 104 may each include or be implemented by hardware and/or software components (e.g., processors, memories, communication interfaces, instructions stored in memory for execution by the processors, etc.). In some examples, facilities 102 and 104 may be distributed between multiple computing devices or systems (e.g., multiple servers, etc.) and/or between multiple locations as may serve a particular implementation. As mentioned above, in certain examples, either or both of facilities 102 and 104 (and/or any portions thereof) may be implemented by a MEC server capable of providing powerful processing resources with relatively large amounts of computing power and relatively short latencies compared to other types of computing systems (e.g., user devices, on-premise computing systems associated with the user devices, cloud computing systems accessible to the user devices by way of the Internet, etc.) that may also be used to implement system 100 or portions thereof (e.g., portions of facilities 102 and/or 104 that are not implemented by the MEC server) in certain implementations. Each of facilities 102 and 104 within system 100 will now be described in more detail.

Storage facility 102 may store and/or otherwise maintain executable data used by processing facility 104 to perform any of the functionality described herein. For example, storage facility 102 may store instructions 106 that may be executed by processing facility 104. Instructions 106 may be executed by processing facility 104 to perform any of the functionality described herein, and may be implemented by any suitable application, software, code, and/or other executable data instance. Additionally, storage facility 102 may also maintain any other data accessed, managed, generated, used, and/or transmitted by processing facility 104 in a particular implementation.

Processing facility 104 may be configured to perform (e.g., execute instructions 106 stored in storage facility 102 to perform) various functions associated with simulating spatially-varying acoustics of an extended reality world. For example, in certain implementations of system 100, processing facility 104 may identify a location, within an extended reality world, of an avatar of a user. The user may be using a media player device to experience the extended reality world via the avatar. Specifically, since the avatar is located at the identified location, the user may experience the extended reality world from the identified location by viewing the world from that location on a screen of the media player device, hearing sound associated with that location using speakers associated with the media player device, and so forth.

Processing facility 104 may further be configured to select an impulse response associated with the identified location of the avatar. Specifically, for example, processing facility 104 may select an impulse response from an impulse response library that includes a plurality of different impulse responses each corresponding to a different subspace of the extended reality world. The impulse response selected may correspond to a particular subspace that is associated with the identified location of the avatar. For instance, the particular subspace may be a subspace within which the avatar is located or to which the avatar is proximate. As will be described in more detail below, in certain examples, multiple impulse responses may be selected from the library in order to combine the impulse responses or otherwise utilize elements of multiple impulse responses as acoustics are simulated.

Processing facility 104 may also be configured to generate an audio stream based on the selected impulse response. For example, the audio stream may be generated such that, when the audio stream is rendered by the media player device, the audio stream presents sound to the user in accordance with simulated acoustics customized to the identified location of the avatar within the extended reality world. In this way, the sound presented to the user may be immersive to the user by comporting with what the user might expect to hear at the current location of his or her avatar within the extended reality world if the world were entirely real rather than simulated or partially simulated.

In some examples, system 100 may be configured to operate in real time so as to provide, receive, process, and/or use the data described above (e.g., data representative of an avatar location, impulse response data, audio stream data, etc.) immediately as the data is generated, updated, changed, or otherwise becomes available. As a result, system 100 may simulate spatially-varying acoustics of an extended reality based on relevant, real-time data so as to allow downstream processing of the audio stream to occur immediately and responsively to other things happening in the overall system. For example, the audio stream may dynamically change to persistently simulate sound as the sound should be heard at each ear of the avatar based on the real-time pose of the avatar within the extended reality world (i.e., the real time location of the avatar and the real-time direction the avatar's head is turned at any given moment).

As used herein, operations may be performed in "real time" when they are performed immediately and without undue delay. In some examples, real-time data processing operations may be performed in relation to data that is highly dynamic and time sensitive (e.g., data that becomes irrelevant after a very short time such as acoustic propagation data indicative of an orientation of a head of the avatar). As such, real-time operations will be understood to refer to those operations that simulate spatially-varying acoustics of an extended reality world based on data that is relevant and up-to-date, even while it will also be understood that real-time operations are not performed instantaneously.

Figure 2:
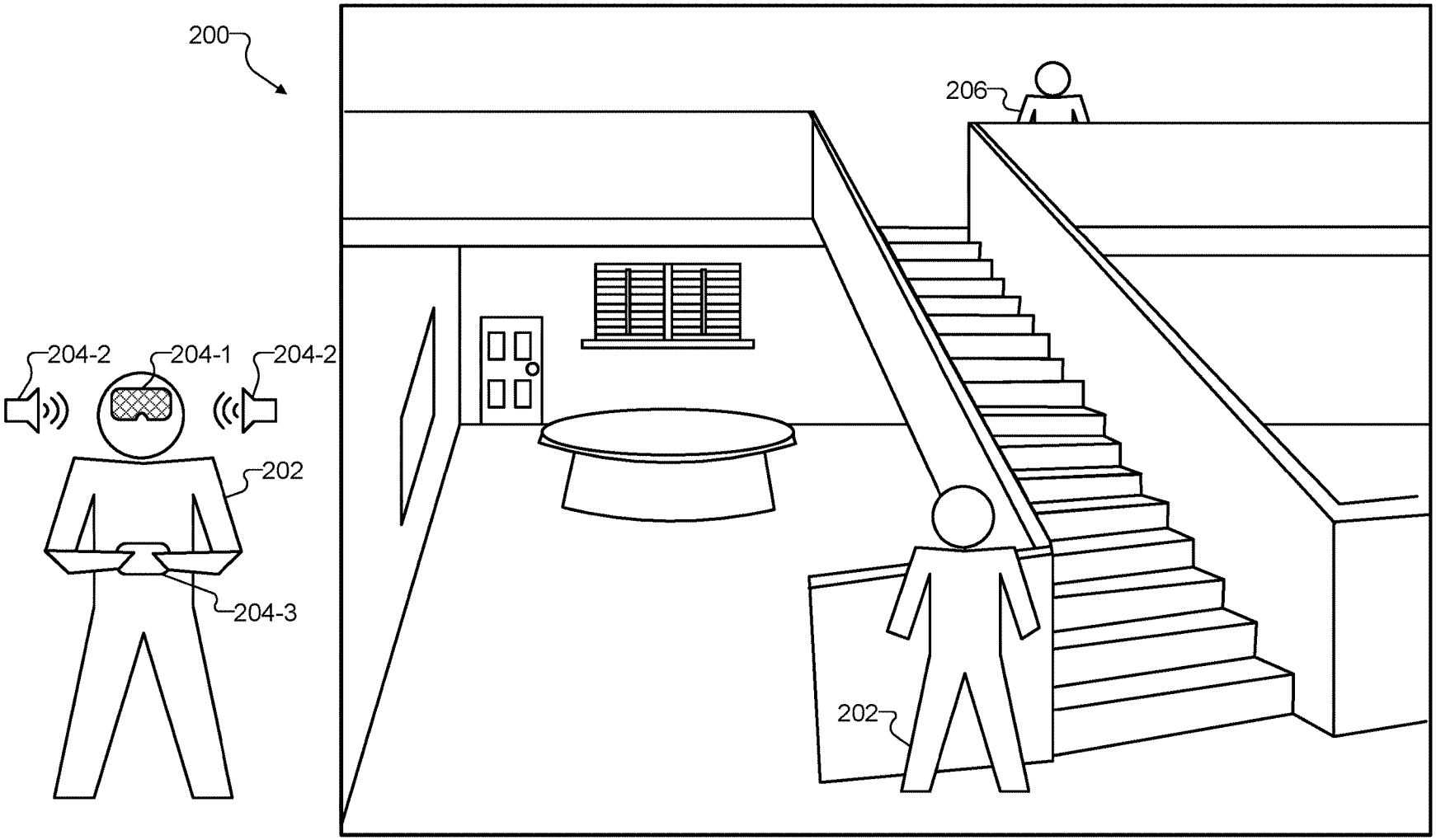
FIG. 2 illustrates an exemplary extended reality world being experienced by an exemplary user according to embodiments described herein.

To illustrate the context in which system 100 may be configured to simulate spatially-varying acoustics of an extended reality world, FIG. 2 shows an exemplary extended reality world 200 being experienced by an exemplary user 202 according to embodiments described herein. As used herein, an extended reality world may refer to any world that may be presented to a user and that includes one or more immersive, virtual elements (i.e., elements that are made to appear to be in the world perceived by the user even though they are not physically part of the real-world environment in which the user is actually located). For example, an extended reality world may be a virtual reality world in which the entire real-world environment in which the user is located is replaced by a virtual world (e.g., a computer-generated virtual world, a virtual world based on a real-world scene that has been captured or is presently being captured with video footage from real world video cameras, etc.). As another example, an extended reality world may be an augmented or mixed reality world in which certain elements of the real-world environment in which the user is located remain in place while virtual elements are imposed onto the real-world environment. In still other examples, extended reality worlds may refer to immersive worlds at any point on a continuum of virtuality that extends from completely real to completely virtual.

In order to experience extended reality world 200, FIG. 2 shows that user 202 may use a media player device that includes various components such as a video headset 204-1, an audio rendering system 204-2, a controller 204-3, and/or any other components as may serve a particular implementation (not explicitly shown). The media player device including components 204-1 through 204-3 will be referred to herein as media player device 204, and it will be understood that media player device 204 may take any form as may serve a particular implementation. For instance, in certain examples, video headset 204-1 may be configured to be worn on the head and to present video to the eyes of user 202, whereas, in other examples, a handheld or stationary device (e.g., a smartphone or tablet device, a television screen, a computer monitor, etc.) may be configured to present the video instead of the head-worn video headset 204-1. Audio rendering system 204-2 may be implemented by either or both of a near-field rendering system (e.g., stereo headphones integrated with video headset 204-1, etc.) and a far-field rendering system (e.g., an array of loudspeakers in a surround sound configuration). Controller 204-3 may be implemented as a physical controller held and manipulated by user 202 in certain implementations. In other implementations, no physical controller may be employed, but, rather, user control may be detected by way of head turns of user 202, hand or other gestures of user 202, or other suitable techniques.

Along with illustrating user 202 and media player device 204, FIG. 2 shows extended reality world 200 ("world 200") that user 202 is experiencing by way of media player device 204. World 200 is shown to be implemented as an interior space that is enclosed by walls, a floor, and a ceiling (not explicitly shown), and that includes various objects (e.g., a stairway, furnishings such as a table, etc.). All of these things may be taken into account by system 100 when simulating how sound propagates and reverberates within the 3D space of world 200. It will be understood that world 200 is exemplary only, and that other implementations of world 200 may be any size (e.g., including much larger than world 200 as illustrated), may include any number of virtual sound sources (e.g., including dozens or hundreds of virtual sound sources or more in certain implementations), and may include any number and/or geometry of objects.

In FIG. 2, an avatar 202 representing or otherwise associated with user 202 is shown to be standing near the bottom of the stairs in the 3D space of world 200. Avatar 202 may be controlled by user 202 (e.g., by moving the avatar using controller 204-3, by turning the head of the avatar by turning his or her own head while wearing video headset 204-1, etc.), who may experience world 200 vicariously by way of avatar 202. Depending on where user 202 places avatar 202 and how he or she orients the head of avatar 202, sounds originating from virtual sound sources in world 200 may virtually propagate and reverberate in different ways before reaching avatar 202. As such, sound originated by a sound source may sound different to user 202 when avatar 202 is near a wall rather than far from it, or when avatar 202 is on the lower level rather than upstairs on the higher level, and so forth.

User 202 may also perceive sound to be different based on where one or more sound sources are located within world 200. For instance, a second avatar 206 representing or otherwise associated with another user (i.e., a user other than user 202 who is not explicitly shown in FIG. 2) is shown to be located on the higher level, near the top of the stairs. If the other user is talking, avatar 206 may represent a virtual sound source originating sound that is to virtually propagate through world 200 to be heard by user 202 via avatar 202 (e.g., based on the pose of avatar 202 with respect to avatar 206 and other objects in world 200, etc.). Accordingly, to accurately simulate sound propagation and reverberation through world 200, an impulse response applied to the sound originated by avatar 206 (i.e., the voice of the user associated with avatar 206, hereafter referred to as "user 206") may account not only for the geometry of world 200 and the objects included therein, but also may account for both the location of avatar 202 (i.e., the listener in this example) and the location of avatar 206 (i.e., the sound source in this example).

While FIG. 2 shows world 200 with a single listener and a single sound source for the sake of clarity, it will be understood that, in certain examples, world 200 may include a plurality of virtual sound sources that can be heard by a listener such as avatar 202. As will be described in more detail below, each combination of such virtual sound sources and their respective locations may be associated with a particular impulse response, or a plurality of impulse responses may be used in combination to generate an audio stream that simulates the proper acoustics customized to the listener location and the plurality of respective sound source locations.

In various examples, any of various types of virtual sound sources may be present in an extended reality world such as world 200. For example, virtual sound sources may include various types of living characters such as avatars of users experiencing world 200 (e.g., avatars 202, 206, and so forth), non-player characters (e.g., a virtual person, a virtual animal or other creature, etc., that is not associated with a user), embodied intelligent assistants (e.g., an embodied assistant implementing APPLE's "Siri," AMAZON's "Alexa," etc.), and so forth. As another example, virtual sound sources may include virtual loudspeakers or other non-character based sources of sound that may present diegetic media content (i.e., media content that is to be perceived as originating at a particular source within world 106 rather than as originating from a non-diegetic source that is not part of world 106), and so forth.

As has been described, system 100 may simulate spatially-varying acoustics of an extended reality world by selecting and updating appropriate impulse responses (e.g., impulse responses corresponding to the respective locations of avatar 202 and/or avatar 206 and other sound sources) from a library of available impulse responses as avatar 202 and/or the sound sources (e.g., avatar 206) move about in world 200. To this end, world 200 may be divided into a plurality of different subspaces, each of which contains or is otherwise associated with various locations in space at which a listener or sound source could be located, and each of which is associated with a particular impulse response within the impulse response library. World 200 may be divided into subspaces in any manner as may serve a particular implementation, and each subspace into which world 200 is divided may have any suitable size, shape, or geometry.

Figure 3:
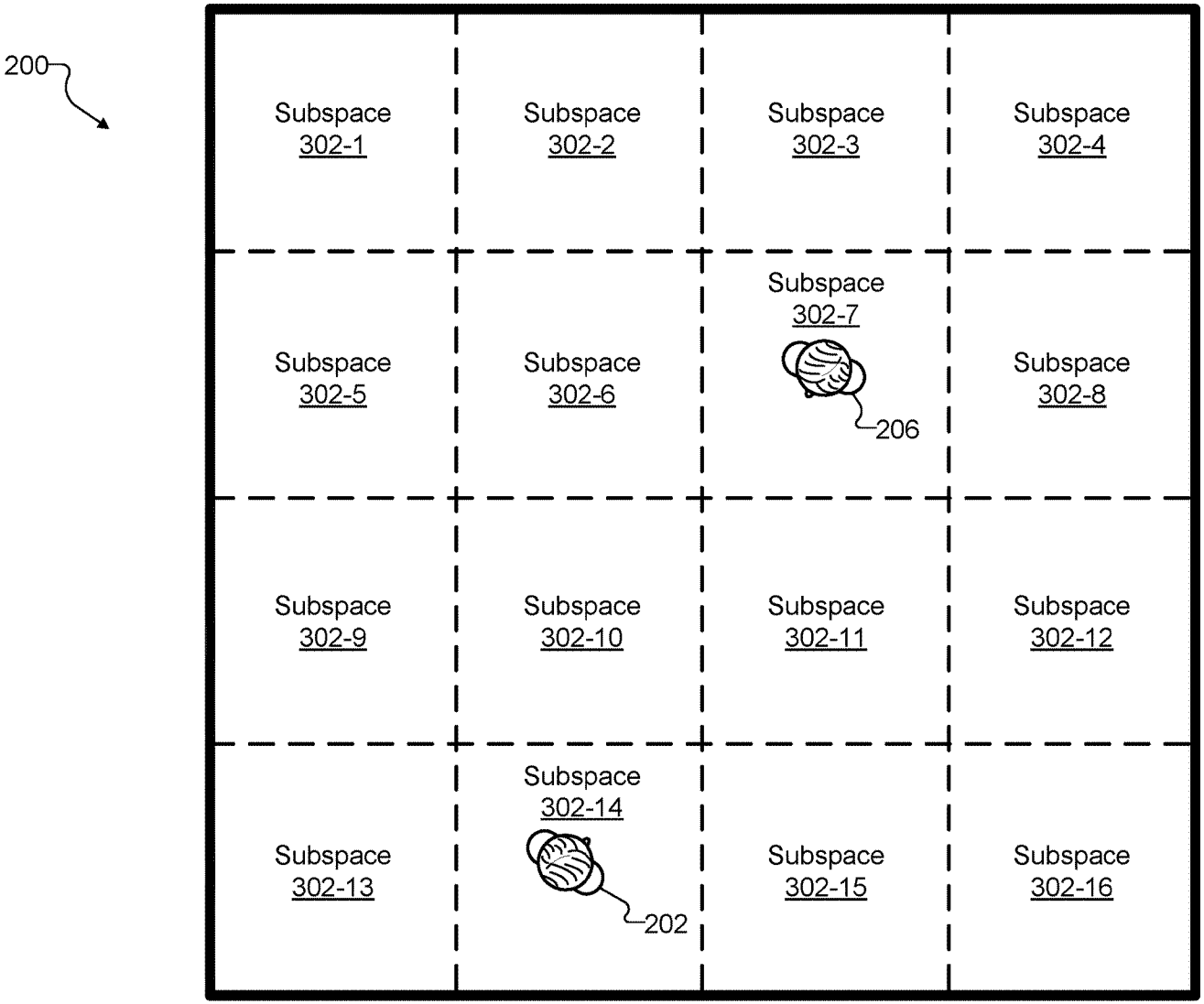
FIG. 3 illustrates exemplary subspaces of the extended reality world of FIG. 2 according to embodiments described herein.

To illustrate, FIG. 3 shows exemplary subspaces 302 (e.g., subspaces 302-1 through 302-16) into which world 200 may be divided in one particular example. In this example, as shown in FIG. 3, each subspace 302 is uniform (i.e., the same size and shape as one another) so as to divide world 200 into a set of equally sized subdivisions with approximately the same shape as world 200 itself (i.e., a square shape). It will be understood, however, that in other examples, extended reality worlds may be divided into subspaces of different sizes and/or shapes as may serve a particular implementation. For instance, rather than equal-sized squares such as shown in FIG. 3, the 3D space of an extended reality world may be divided in other ways such as to account for an irregular shape of the room, objects in the 3D space (e.g., the stairs in world 200, etc.), or the like. In some examples, extended reality worlds may be divided in a manner that each subspace thereof is configured to have approximately the same acoustic properties at every location within the subspace. For instance, if an extended reality world includes a house with several rooms, each subspace may be fully contained within a particular room (i.e., rather than split across multiple rooms) because each room may tend to have relatively uniform acoustic characteristics across the room while having different acoustic characteristics from other rooms. In certain examples, multiple subspaces may be included in a single room to account for differences between acoustic characteristics at different parts of the room (e.g., near the center, near different walls, etc.).

World 200 is shown from a top view in FIG. 3, and, as such, each subspace 302 is shown in two dimensions from overhead. While certain extended reality worlds may be divided up in this manner (i.e., a two-dimensional ("2D") manner that accounts only for length and width of a particular area and not the height of a particular volume), it will be understood that other extended reality worlds may be divided into 3D volumes that account not only for length and width along a 2D plane, but also height along a third dimension in a 3D space. Accordingly, for example, while it is not explicitly shown in FIG. 3, it will be understood that subspaces 302 may be distributed in multiple layers at different heights (e.g., a first layer of subspaces nearer the floor or on the lower level of the space illustrated in FIG. 2, a second layer of subspaces nearer the ceiling or on the upper level of the space illustrated in FIG. 2, etc.).

Larger numbers of subspaces that a given extended reality world is divided into may correspond with smaller subspace areas or volumes. As such, more subspaces may equate to an increased resolution and more accurate representation, location to location, of the simulated effect of the associated impulse response of each subspace. Consequently, it will be understood that the more impulse responses are available to system 100 in the impulse response library, the more accurately system 100 may model sound for locations across world 200, and, while sixteen subspaces are shown in FIG. 3 for illustrative purposes, any suitable number greater than or less than sixteen subspaces may be defined for any particular implementation of world 200 as may best serve that particular implementation.

Figure 4:
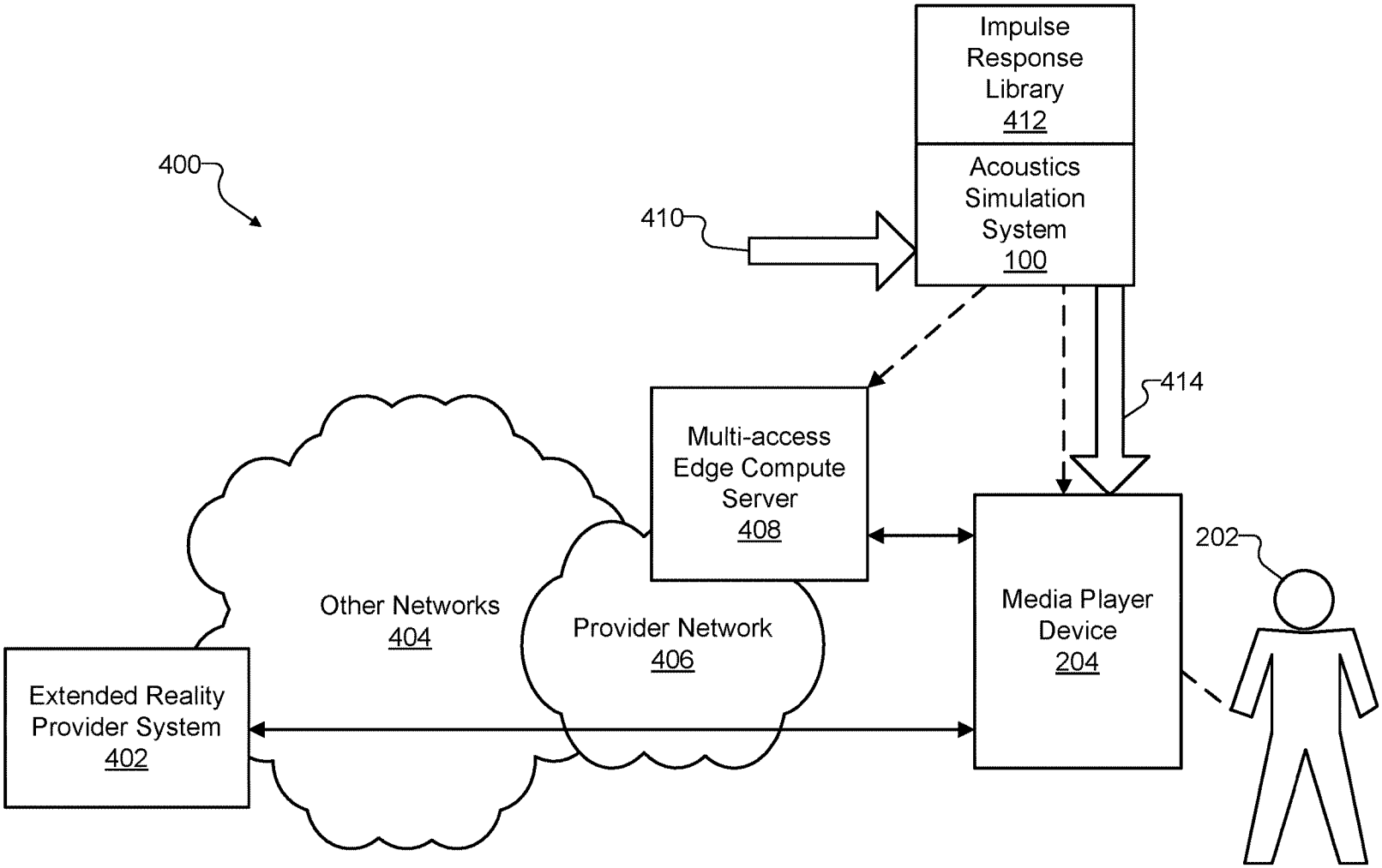
FIG. 4 illustrates an exemplary configuration in which an acoustics simulation system operates to simulate spatially-varying acoustics of an extended reality world according to embodiments described herein.

FIG. 4 illustrates an exemplary configuration 400 in which system 100 operates to simulate spatially-varying acoustics of world 200. Specifically, as shown in FIG. 4, configuration 400 may include an extended reality provider system 402 ("provider system 402") that is communicatively coupled with media player device 204 by way of various networks making up the Internet ("other networks 404") and a provider network 406 that serves media player device 204. As illustrated by dashed lines in FIG. 4, system 100 may be partially or fully implemented by media player device 204 or by a MEC server 408 that is implemented on or as part of provider network 406.

In other configurations, it will be understood that system 100 may be partially or fully implemented by other systems or devices. For instance, certain elements of system 100 may be implemented by provider system 402, by a third party cloud computing server, or by any other system as may serve a particular implementation (e.g., including a standalone system dedicated to performing operations for simulating spatially-varying acoustics of extended reality worlds).

System 100 is shown to receive audio data 410 from one or more audio data sources not explicitly shown in configuration 400. System 100 is also shown to include, be coupled with, or have access to an impulse response library 412. In this way, system 100 may perform any of the operations described herein to simulate spatially-varying acoustics of an extended reality world and ultimately generate an audio stream 414 to be transmitted to audio rendering system 204-2 of media player device 402 (e.g., from MEC server 408 if system 100 is implemented by MEC server 408, or from a different part of media player device 204 if system 100 is implemented by media player device 204). Each of the components illustrated in configuration 400 will now be described in more detail.

Provider system 402 may be implemented by one or more computing devices or components managed and maintained by an entity that creates, generates, distributes, and/or otherwise provides extended reality media content to extended reality users such as user 202. For example, provider system 402 may include or be implemented by one or more server computers maintained by an extended reality provider. Provider system 402 may provide video data and/or other non-audio-related data representative of an extended reality world to media player device 204. Additionally, provider system 402 may be responsible for providing at least some of audio data 410 in certain implementations.

Collectively, networks 404 and 406 may provide data delivery means between server-side provider system 402 and client-side devices such as media player device 204 and other media player devices not explicitly shown in FIG. 4. In order to distribute extended reality media content from provider systems to client devices, networks 404 and 406 may include wired or wireless network components and may employ any suitable communication technologies. Accordingly, data may flow between server-side systems (e.g., provider system 402, MEC server 408, etc.) and media player device 204 using any communication technologies, devices, media, and protocols as may serve a particular implementation.

Provider network 406 may provide, for media player device 204 and other media player devices not shown, communication access to provider system 402, to other media player devices, and/or to other systems and/or devices as may serve a particular implementation. Provider network 406 may be implemented by a provider-specific wired or wireless communications network (e.g., a cellular network used for mobile phone and data communications, a 4G or 5G network or network of another suitable technology generation, a cable or satellite carrier network, a mobile telephone network, etc.), and may be operated and/or managed by a provider entity such as a mobile network operator (e.g., a wireless service provider, a wireless carrier, a cellular company, etc.). The provider of provider network 406 may own and/or control all of the elements necessary to provide and deliver communications services for media player device 204 and/or other devices served by provider network 406 (e.g., other media player devices, mobile devices, IoT devices, etc.). For example, the provider may own and/or control network elements including radio spectrum allocation, wireless network infrastructure, back haul infrastructure, provisioning of devices, network repair for provider network 406, and so forth.

Other networks 404 may include any interconnected network infrastructure that is outside of provider network 406 and outside of the control of the provider. For example, other networks 404 may include one or more of the Internet, a wide area network, a content delivery network, and/or any other suitable network or networks managed by any third parties outside of the control of the provider of provider network 406.

Various benefits and advantages may result when audio stream generation, including spatially-varying acoustics simulation described herein, is performed using multi-access servers such as MEC server 408. As used herein, a MEC server may refer to any computing device configured to perform computing tasks for a plurality of client systems or devices. MEC server 408 may be configured with sufficient computing power (e.g., including substantial memory resources, substantial storage resources, parallel central processing units ("CPUs"), parallel graphics processing units ("GPUs"), etc.) to implement a distributed computing configuration wherein devices and/or systems (e.g., including, for example, media player device 204) can offload certain computing tasks to be performed by the powerful resources of the MEC server. Because MEC server 408 is implemented by components of provider network 406 and is thus managed by the provider of provider network 406, MEC server 408 may be communicatively coupled with media player device 204 with relatively low latency compared to other systems (e.g., provider system 402 or cloud-based systems) that are managed by third party providers on other networks 404. Because only elements of provider network 406, and not elements of other networks 404, are used to connect media player device 204 to MEC server 408, the latency between media player device 204 and MEC server 408 may be very low and predictable (e.g., low enough that MEC server may perform operations with such low latency as to be perceived by user 202 as being instantaneous and without any delay).

While provider system 402 provides video-based extended reality media content to media player device 204, system 100 may be configured to provide audio-based extended reality media content to media player device 204 in any of the ways described herein. In certain examples, system 100 may operate in connection with another audio provider system (e.g., implemented within MEC server 408) that generates the audio stream that is to be rendered by media player device 204 (i.e., by audio rendering system 204-2) based on data generated by system 100. In other examples, system 100 may itself generate and provide audio stream 414 to the audio rendering system 204-2 of media player device 204 based on audio data 410 and based on one or more impulse responses from impulse response library 412.

Audio data 410 may include any audio data representative of any sound that may be present within world 200 (e.g., sound originating from any of the sound sources described above or any other suitable sound sources). For example, audio data 410 may be representative of voice chat spoken by one user (e.g., user 206) to be heard by another user (e.g., user 202), sound effects originating from any object within world 200, sound associated with media content (e.g., music, television, movies, etc.) being presented on virtual screens or loudspeakers within world 200, synthesized audio generated by non-player characters or automated intelligent assistants within world 200, or any other sound as may serve a particular implementation.

As mentioned above, in certain examples, some or all of audio data 410 may be provided (e.g., along with various other extended reality media content) by provider system 402 over networks 404 and/or 406. In certain of the same or other examples, audio data 410 may be accessed from other sources such as from a media content broadcast (e.g., a television, radio, or cable broadcast), another source unrelated to provider system 402, a storage facility of MEC server 408 or system 100 (e.g., storage facility 102), or any other audio data source as may serve a particular implementation.

Because it is desirable for media player device 204 to ultimately render audio that will mimic sound surrounding avatar 202 in world 200 from all directions (i.e., so as to make world 202 immersive to user 202), audio data 410 may be recorded and received in a spherical format (e.g., an ambisonic format), or, if recorded and received in another format (e.g., a monaural format, a stereo format, etc.), may be converted to a spherical format by system 100. For example, certain sound effects that are prerecorded and stored so as to be presented in connection with certain events or characters of a particular extended reality world may be recorded or otherwise generated using spherical microphones configured to generate ambisonic audio signals. In contrast, voice audio spoken by a user such as user 206 may be captured as a monaural signal by a single microphone, and may thus need to be converted to an ambisonic audio signal. Similarly, a stereo audio stream received as part of media content (e.g., music content, television content, movie content, etc.) that is received and is to be presented within world 200 may also be converted to an ambisonic audio signal.

Moreover, while spherical audio signals received or created in the examples above may be in recorded or generated as A-format ambisonic signals, it may be advantageous, prior to or as part of the audio processing performed by system 100, to convert the A-format ambisonic signals to B-format ambisonic signals that are configured to be readily rendered into binaural signals that can be presented to user 202 by audio rendering system 204-2.

Figure 5:
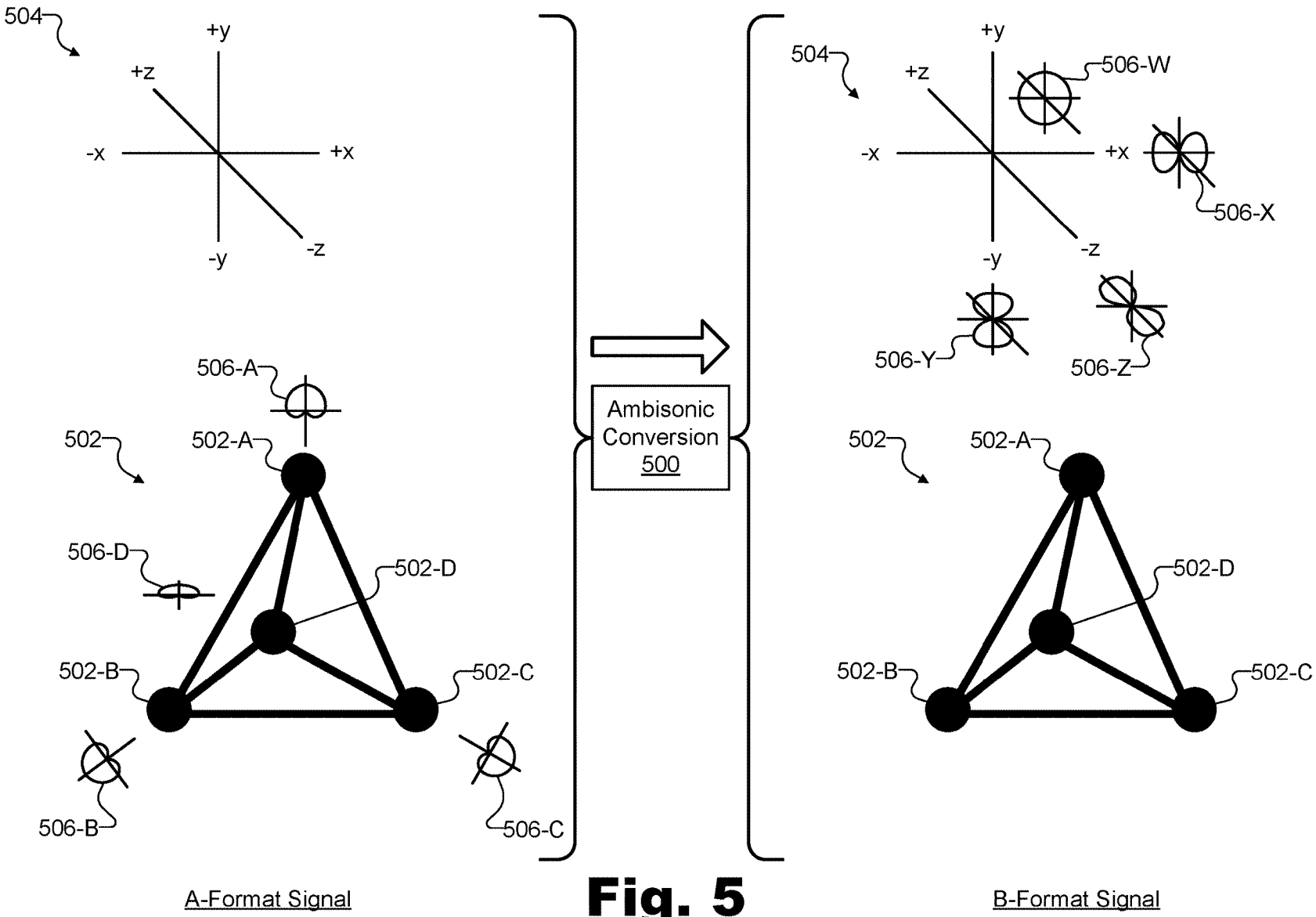
FIG. 5 illustrates exemplary aspects of an ambisonic conversion of an audio signal from one ambisonic format to another according to embodiments described herein.

To illustrate, FIG. 5 shows certain aspects of exemplary ambisonic signals (i.e., an A-format ambisonic signal on the left and a B-format ambisonic signal on the right), as well as exemplary aspects of an ambisonic conversion 500 of an audio signal (e.g., an audio signal represented within audio data 410) from the ambisonic A-format to the B-format. It will be understood that, for audio streams represented within audio data 410 that are not in the ambisonic A-format (e.g., audio streams in a monaural, stereo, or other format), a conversion to the ambisonic B-format may be performed directly or indirectly from the original format. For example, an ambisonic B-format signal may be synthesized directly or indirectly from a monaural signal, from a stereo signal, or from various other signals of other formats.

The A-format signal in FIG. 5 is illustrated as being associated with a tetrahedron 502 and a coordinate system 504. The A-format signal may include an audio signal associated with each of the four vertices 502-A through 502-D of tetrahedron 502. More particularly, as illustrated by polar patterns 506 that correspond to vertices 502 (i.e., polar pattern 506-A corresponding to vertex 502-A, polar pattern 506-B corresponding to vertex 502-B, polar pattern 506-C corresponding to vertex 502-C, and polar pattern 506-D corresponding to vertex 502-D), each of the individual audio signals in the overall A-format ambisonic signal may represent sound captured by a directional microphone (or simulated to have been captured by a virtual directional microphone) disposed at the respective vertex 502 and oriented outward away from the center of the tetrahedron.

While an A-format signal such as shown in FIG. 5 may be straightforward to record or simulate (e.g., by use of an ambisonic microphone including four directional microphone elements arranged in accordance with polar patterns 506), it is noted that the nature of tetrahedron 502 make it impossible for more than one of cardioid polar patterns 506 to align with an axis of coordinate system 504 in any given arrangement of tetrahedron 502 with respect to coordinate system 504. Because the A-format signal does not line up with the axes of coordinate system 504, ambisonic conversion 500 may be performed to convert the A-format signal into a B-format signal that can be aligned with each of the axes of coordinate system 504. Specifically, as shown after ambisonic conversion 500 has been performed, rather than polar patterns 506 aligning with tetrahedron 502 like polar patterns 506-A through 506-D, the polar patterns 506 of the individual audio signals that make up the overall B-format signal (i.e., polar patterns 506-W, 506-X, 506-Y, and 506-Z) are configured to align with coordinate system 504. For example, a first signal has a figure-eight polar pattern 506-X that is directional along the x-axis of coordinate system 504, a second signal has a figure-eight polar pattern 506-Y that is directional along the y-axis of coordinate system 504, a third signal has a figure-eight polar pattern 506-Z that is directional along the z-axis of coordinate system 504, and a fourth signal has an omnidirectional polar pattern 506-W that can be used for non-directional aspects of a sound (e.g., low sounds to be reproduced by a subwoofer or the like).

While FIG. 5 illustrates elements of first order ambisonic signals composed of four individual audio signals, it will be understood that certain embodiments may utilize higher-order ambisonic signals composed of other suitable numbers of audio signals, or other types of spherical signals as may serve a particular implementation.

Returning to FIG. 4, system 100 may process each of the audio streams represented in audio data 410 (e.g., in some cases after performing ambisonic and/or other conversions of the signals such as described above) in accordance with one or more impulse responses. As described above, by convolving or otherwise applying appropriate impulse responses to audio signals prior to providing the signals for presentation to user 202, system 100 may cause the audio signals to replicate, on the final sound that is presented, various reverberations and other acoustic effects of the virtual acoustic environment of world 200. To this end, system 100 may have access to impulse response library 412, which may be managed by system 100 itself (e.g., integrated as part of system 100 such as by being implemented within storage facility 102), or which may be implemented on another system communicatively coupled to system 100.

FIG. 6 illustrates impulse response library 412 in more detail. As shown in FIG. 6, impulse response library 412 includes a plurality of different impulse responses each corresponding to one or more different subspaces of world 200. In some implementations, for instance, the different subspaces to which the impulse responses correspond may be associated with different listener locations in the extended reality world. For example, impulse response library 412 may include a respective impulse response for each of subspaces 302 of world 200, and system 100 may select an impulse response corresponding to a subspace 302 within which avatar 202 is currently located or to which avatar 202 is currently proximate.

In certain implementations, each of the impulse responses included in impulse response library 412 may further correspond, along with corresponding to one of the different listener locations in the extended reality world, to an additional subspace 302 associated with a potential sound source location in world 200. In these implementations, system 100 may select an impulse response based on not only the subspace 302 within which avatar 202 is currently located (and/or a subspace 302 to which avatar 202 is currently proximate), but also based on a subspace 302 within which a sound source is currently located (or to which the sound source is proximate).

As shown in FIG. 6, impulse response library 412 may implement this type of embodiment. Specifically, as indicated by indexing information (shown in the "Indexing" columns) for each impulse response (shown in the "Impulse Response Data" column), each impulse response may correspond to both a listener location and a source location that can be the same or different from one another. FIG. 6 explicitly illustrates indexing and impulse response data for each of the sixteen combinations that can be made for four different listener locations ("ListenerLocation_01" through "ListenerLocation_04") and four different source locations ("SourceLocation_01" through "SourceLocation_04"). Specifically, the naming convention used to label each impulse response stored in impulse response library 412 (i.e., in the impulse response data column) indicates both an index of the subspace associated with the listener location (e.g., subspace 302-1 for "ImpulseResponse_01_02") and an index of the subspace associated with the sound source location (e.g., subspace 302-2 for "Impulse Response_01_02").

While a relatively limited number of impulse responses are explicitly illustrated in FIG. 6, it will be understood that each ellipsis may represent one or more additional impulse responses associated with additional indexing parameters, such that impulse response library 412 may include more or fewer impulse responses than shown in FIG. 6. For example, impulse response library 412 may include a relatively large number of impulse responses to account for every possible combination of a subspace 302 of the listener and a subspace 302 of the sound source for world 200. In some examples, an impulse response library such as impulse response library 412 may include even more impulse responses. For instance, an extended reality world divided into more subspaces than world 200 would have even more combinations of listener and source locations to be accounted for. As another example, certain impulse response libraries may be implemented to account for more than one sound source location per impulse response. For instance, one or more additional indexing columns could be added to impulse response library 412 as illustrated in FIG. 6, and additional combinations accounting for every potential listener location subspace together with every combination of two or more sound source location subspaces that may be possible for a particular extended reality world could be included in the impulse response data of the library.

Each of the impulse responses included in an impulse response library such as impulse response library 412 may be generated at any suitable time and in any suitable way as may serve a particular implementation. For example, the impulse responses may be created and organized prior to the presentation of the extended reality world (e.g., prior to the identifying of the location of the avatar, as part of the creation of a preconfigured extended reality world or scene thereof, etc.). As another example, some or all of the impulse responses in impulse response library 412 may be generated or revised dynamically while the extended reality world is being presented to a user. For instance, impulse responses may be dynamically revised and updated as appropriate if it is detected that environmental factors within an extended reality world cause the acoustics of the world to change (e.g., as a result of virtual furniture being moved in the world, as a result of walls being broken down or otherwise modified, etc.). As another example in which impulse responses may be generated or revised dynamically, impulse responses may be initially created or modified (e.g., made more accurate) as a user directs an avatar to explore a portion of an extended reality world for the first time and as the portion of the extended reality world is dynamically mapped both visually and audibly for the user to experience.

As for the manner in which the impulse responses in a library such as impulse response library 412 are generated, any suitable method and/or technology may be employed. For instance, in some implementations, some or all of the impulse responses may be defined by recording the impulse responses using one or more microphones (e.g., an ambisonic microphone such as described above that is configured to capture an A-format ambisonic impulse response) placed at respective locations corresponding to the different subspaces of the extended reality world (e.g., placed in the center of each subspace 302 of world 200). For example, the microphones may record, from each particular listener location (e.g., locations at the center of each particular subspace 302), the sound heard at the listener location when an impulse sound representing a wide range of frequencies (e.g., a starter pistol, a sine sweep, a balloon pop, a chirp from 0-20 kHz, etc.) is made at each particular sound source location (e.g., the same locations at the center of each particular subspace 302).

In the same or other implementations, some or all of the impulse responses may be defined by synthesizing the impulse responses based on respective acoustic characteristics of the respective locations corresponding to the different subspaces of the extended reality world (e.g., based on how sound is expected to propagate to or from a center of each subspace 302 of world 200). For example, system 100 or another impulse response generation system separate from system 100 may be configured to perform a soundwave raytracing technique to determine how soundwaves originating at one point (e.g., a sound source location) will echo, reverberate, and otherwise propagate through an environment to ultimately arrive at another point in the world (e.g., a listener location).

Figure 7:
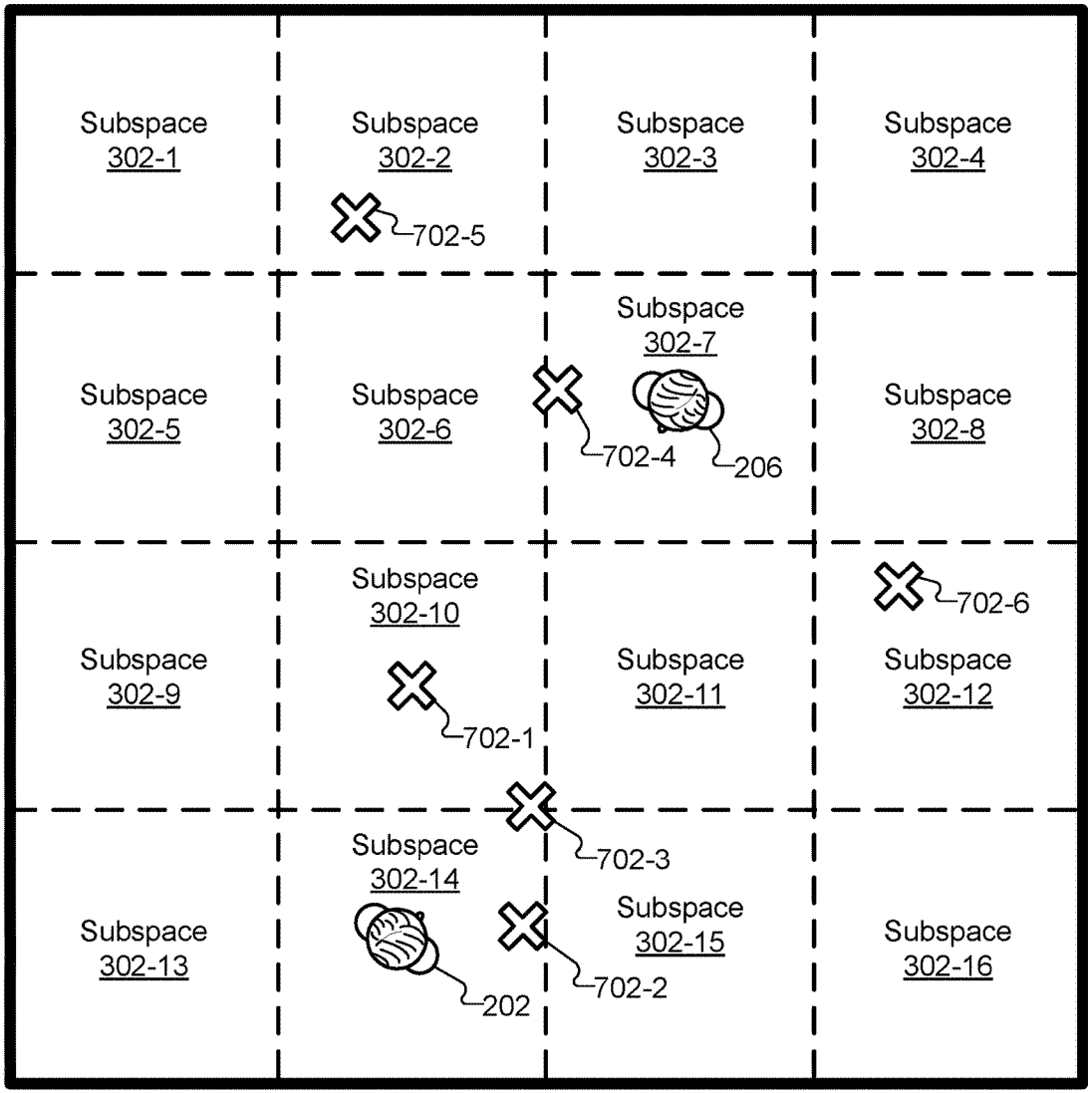
FIG. 7 illustrates exemplary listener and sound source locations with respect to the subspaces of the extended reality world according to embodiments described herein.

In operation, system 100 may access a single impulse response from impulse response library 412 that corresponds to a current location of the listener (e.g., avatar 202) and the sound source (e.g., avatar 206, who, as described above, will be assumed to be speaking to avatar 202 in this example). To illustrate this example, FIG. 7 shows the exemplary subspaces 302 of world 200 (described above in relation to FIG. 3), including a subspace 302-14 at which avatar 202 is located, and a subspace 302-7 at which avatar 206 is located. Based on the respective locations of the listener (i.e., avatar 202 in this example) and the sound source (i.e., avatar 206 in this example), system 100 may select, from impulse response library 412, an impulse response corresponding to both subspace 302-14 (as the listener location) and subspace 302-7 (as the source location). For example, to use the notation introduced in FIG. 6, system 100 may select an impulse response "ImpulseResponse_14_07" (not explicitly shown in FIG. 6) that has a corresponding listener location at subspace 302-14 and a corresponding source location at subspace 302-7.

While this impulse response may well serve the presentation of sound to user 202 while both avatar 202 and avatar 206 are positioned in world 200 as shown in FIG. 7, it will be understood that a different impulse response may need to be dynamically selected as things change in the world (e.g., due to movement of avatar 202 by user 202, due to movement of avatar 206 by user 206, etc.). More particularly, for example, system 100 may identify, subsequent to the selecting of ImpulseResponse_14_07 based on the subspaces of the identified locations of avatars 202 and 206, a second location within world 200 to which avatar 202 has relocated from the identified location. For instance, if user 202 directs avatar 202 to move from the location shown in subspace 302-14 to a location 702-1 at the center of subspace 302-10, system 100 may select, from impulse response library 412, a second impulse response that corresponds to a second particular subspace associated with location 702-1 (i.e., subspace 302-10). Assuming for this example that the sound source avatar 206 has not also moved, the same source location subspace may persist and system 100 may thus select an impulse response corresponding to subspace 302-10 for the listener location and to subspace 302-7 for the source location (i.e., ImpulseResponse_10_07, to use the notation of FIG. 6).

Accordingly, system 100 may modify, based on the second impulse response (ImpulseResponse_10_07), the audio stream being generated such that, when the audio stream is rendered by the media player device, the audio stream presents sound to user 202 in accordance with simulated acoustics customized to location 702-1 in subspace 302-10, rather than to the original identified location in subspace 302-14. In some examples, this modification may take place gradually such that a smooth transition from effects associated with ImpulseResponse_14_07 to effects associated with ImpulseResponse_10_07 are applied to sound presented to the user. For example, system 100 may crossfade or otherwise gradually transition from one impulse response (or combination of impulse responses) to another impulse response (or other combination of impulse responses) in a manner that sounds natural, continuous, and realistic to the user.

In the examples described above, it may be relatively straightforward for system 100 to determine the most appropriate impulse response because both the listener location (i.e., the location of avatar 202) and the source location (i.e., the location of avatar 206) are squarely contained within designated subspaces 302 at the center of their respective subspaces. Other examples in which avatars 202 and/or 206 are not so squarely positioned at the center of their respective subspaces, and/or in which multiple sound sources are present, however, may lead to more complex impulse response selection scenarios. In such scenarios, system 100 may be configured to select and apply more than one impulse response at a time to create an effect that mixes and makes use of elements of multiple selected impulse responses.

For instance, a scenario will be considered in which user 202 directs avatar 202 to move from the location shown in subspace 302-14 to a location 702-2 (which, as shown, is not centered in any subspace 302, but rather is proximate to a boundary between subspaces 302-14 and 302-15). In this example, the selecting of an impulse response by system 100 may include not only selecting the first impulse response (i.e., ImpulseResponse_14_07), but further selecting an additional impulse response that corresponds to subspace 302-15 (i.e., ImpulseResponse_15_07). Accordingly, the generating of the audio stream performed by system 100 may be performed based not only on the first impulse response (i.e., ImpulseResponse_14_07), but also further based on the additional impulse response (i.e., ImpulseResponse_15_07). In a similar scenario (or at a later time in the scenario described above), user 202 may direct avatar 202 to move to a location 702-3, which, as shown, is proximate to two boundaries (i.e., a corner) where subspaces 302-10, 302-11, 302-14, and 302-15 all meet. In this scenario, as in the example described above in relation to location 702-2, system 100 may be configured to select four impulse responses corresponding to the source location and to each of the four subspaces proximate to or containing location 702-3. Specifically, system 100 may select ImpulseResponse_10_07, ImpulseResponse_11_07, ImpulseResponse_14_07, and ImpulseResponse_15_07.

As another example, a scenario will be considered in which avatar 202 is still located at the location shown at the center of subspace 302-14, but where avatar 206 (i.e., the sound source in this example) moves from the location shown at the center of subspace 302-7 to a location 702-4 (which, as shown, is not centered in any subspace 302, but rather is proximate a boundary between subspaces 302-7 and 302-6). In this example, the selecting of an impulse response by system 100 may include not only selecting the first impulse response corresponding to the listener location subspace 302-14 and the original source location subspace 302-7 (i.e., ImpulseResponse_14_07), but further selecting an additional impulse response that corresponds to the listener location subspace 302-14 (assuming that avatar 202 has not also moved) and to source location subspace 302-6 to which location 702-4 is proximate. Accordingly, the generating of the audio stream performed by system 100 may be performed based not only on the first impulse response (i.e., ImpulseResponse_14_07), but also further based on the additional impulse response (i.e., ImpulseResponse_14_06). While not explicitly described herein, it will be understood that, in additional examples, appropriate combinations of impulse responses may be selected when either or both of the listener and the sound source move to other locations in world 200 (e.g., four impulse responses if avatar 206 moves near a corner connecting four subspaces 302, up to eight impulse responses if both avatars 202 and 206 are proximate corners connecting four subspaces 302, etc.).

As yet another example, a scenario will be considered in which avatar 202 is still located at the location shown at the center of subspace 302-14, but where, instead of avatar 206 serving as the sound source, a first and a second sound source located, respectively, at a location 702-5 and a location 702-6 originate virtual sound that propagates through world 200 to avatar 202 (who is still the listener in this example). In this example, the selecting of an impulse response by system 100 may include selecting a first impulse response that corresponds to subspace 302-14 associated with the identified location of avatar 202 and to subspace 302-2, which is associated with location 702-5 of the first sound source. For example, this first impulse response may be ImpulseResponse_14_02. Moreover, the selecting of the impulse response by system 100 may further include selecting an additional impulse response that corresponds to subspace 302-14 associated with the identified location of avatar 202 and to subspace 302-12, which is associated with location 702-6 of the second sound source. For example, this additional impulse response may be ImpulseResponse_14_12. In this scenario, the generating of the audio stream by system 100 may be performed based on both the first impulse response (i.e., ImpulseResponse_14_02) as well as the additional impulse response (i.e., ImpulseResponse_14_12).

Returning to FIG. 4, once system 100 has selected one or more impulse responses from impulse response library 412 in any of the ways described above, system 100 may generate audio stream 414 based on the one or more impulse responses that have been selected. The selection of the one or more impulse responses, as well as the generation of audio stream 414 may be performed based on various data received from media player device 204 or another suitable source. For example, media player device 204 may be configured to determine, generate, and provide various types of data that may be used by provider system 402 and/or system 100 to provide the extended reality media content. For example, media player device 204 may provide acoustic propagation data that helps describe or indicate how virtual sound propagates in world 200 from a virtual sound source such as avatar 206 to a listener such as avatar 202. Acoustic propagation data may include world propagation data as well as head pose data.

World propagation data, as used herein, may refer to data that dynamically describes propagation effects of a variety of virtual sound sources from which virtual sounds heard by avatar 202 may originate. For example, world propagation data may include real-time information about poses, sizes, shapes, materials, and environmental considerations of one or more virtual sound sources included in world 206. Thus, for example, if avatar 206 turns to face avatar 202 directly or moves closer to avatar 202, world propagation data may include data describing this change in pose that may be used to make the audio more prominent (e.g., louder, more pronounced, etc.) in audio stream 414. In contrast, world propagation data may similarly include data describing a pose change of the virtual sound source when turning to face away from avatar 202 and/or moving farther from avatar 202, and this data may be used to make the audio less prominent (e.g., quieter, fainter, etc.) in audio stream 414. Effects that are applied to sounds presented to user 202 based on world propagation may augment or serve as an alternative to effects on the sound achieved by applying one or more of the impulse responses from impulse response library 412.

Head pose data may describe real-time pose changes of avatar 202 itself. For example, head pose data may describe movements (e.g., head turn movements, point-to-point walking movements, etc.) or control actions performed by user 202 that cause avatar 202 to change pose within world 200. When user 202 turns his or her head, for example, interaural time differences, interaural level differences, and other cues that may assist user 202 in localizing sounds may need to be recalculated and adjusted in a binaural audio stream being provided to media player device 204 (e.g., audio stream 414) in order to properly model how virtual sound arrives at the virtual ears of avatar 202. Head pose data thus tracks these types of variables and provides them to system 100 so that head turns and other movements of user 202 may be accounted for in real time as impulse responses are selected and applied, and as audio stream 414 is generated and provided to media player device 204 for presentation to user 202. For instance, based on head pose data, system 100 may use digital signal processing techniques to model virtual body parts of avatar 202 (e.g., the head, ears, pinnae, shoulders, etc.) and perform binaural rendering of audio data that accounts for how those virtual body parts affect the virtual propagation of sound to avatar 202. To this end, system 100 may determine a head related transfer function ("HRTF") for avatar 202 and may employ the HRTF as the digital signal processing is performed to generate the binaural rendering of audio stream 414 so as to mimic the sound avatar 202 would hear if the virtual sound propagation and virtual body parts of avatar 202 were real.

Because of the low-latency nature of MEC server 408, system 100 may receive real-time acoustic propagation data from media player device 204 regardless of whether system 100 is implemented as part of media player device 204 itself or is integrated with MEC server 408. Moreover, system 100 may be configured to return audio stream 414 to media player device 204 with a small enough delay that user 202 perceives the presented audio as being instantaneously responsive to his or her actions (e.g., head turns, etc.). For example, real-time acoustic propagation data accessed by system 100 may include head pose data representative of a real-time pose (e.g., including a position and an orientation) of avatar 202 at a first time while user 202 is experiencing world 200, and the transmitting of audio stream 414 by system 100 may be performed at a second time that is within a predetermined latency threshold after the first time. For instance, the predetermined latency threshold may be about 10 ms, 20 ms, 50 ms, 100 ms, or any other suitable threshold amount of time that is determined, in a psychoacoustic analysis of users such as user 202, to result in sufficiently low-latency responsiveness to immerse the users in world 200 without perceiving that sound being presented has any delay.

Figure 8:
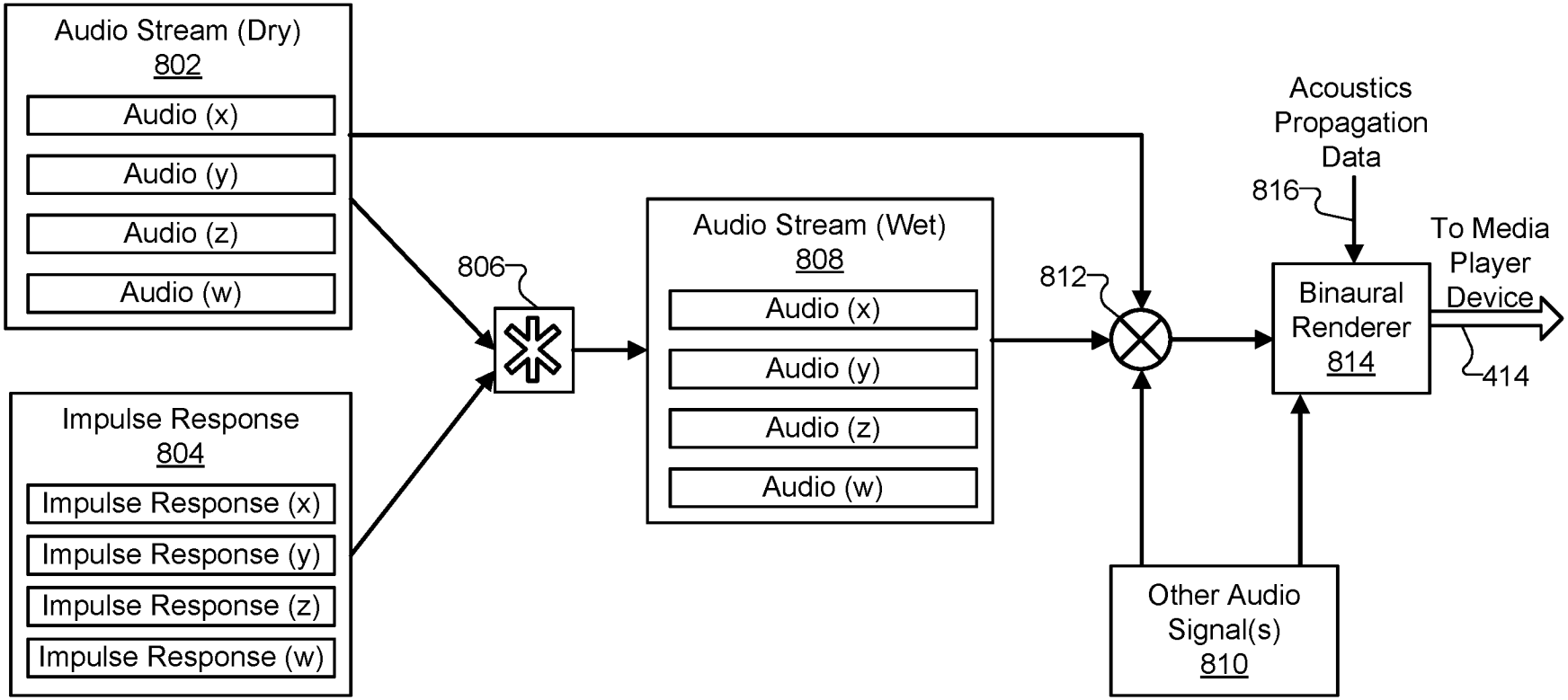
FIG. 8 illustrates exemplary aspects of how an audio stream may be generated by an acoustics simulation system to simulate spatially-varying acoustics of an extended reality world according to embodiments described herein.

In order to illustrate how system 100 may generate audio stream 414 to simulate spatially-varying acoustics of world 200, FIG. 8 shows exemplary aspects of the generation of audio stream 414 by system 100. Specifically, as shown in FIG. 8, the generation of audio stream 414 by system 100 may involve applying, to an audio stream 802, an impulse response 804. For example, impulse response 804 may be applied to audio stream 802 by convolving the impulse response with audio stream 802 using a convolution operation 806 to generate an audio stream 808. Because the effects of impulse response 804 are not yet applied to audio stream 802, this audio stream may be referred to as a "dry" audio stream, whereas, since impulse response 804 has been applied to audio stream 808, this audio stream may be referred to as a "wet" audio stream. Wet audio stream 808 may be mixed with dry audio stream 802 and one or more other audio signals 810 by a mixer 812 to generate an audio stream that is processed by a binaural renderer 814 that accounts for acoustic propagation data 816 to thereby render the final binaural audio stream 414 that is provided to media player device 204 for presentation to user 202. Each of the elements of FIG. 8 will now be described in more detail.

Dry audio stream 802 may be received by system 100 from any suitable audio source. For instance, audio stream 802 may be included as one of several streams or signals represented by audio data 410 illustrated in FIG. 4 above. In some examples, audio stream 802 may be a spherical audio stream representative of sound heard from all directions by a listener (e.g., avatar 202) within an extended reality world. In these examples, audio stream 802 may thus incorporate virtual acoustic energy that arrives at avatar 202 from multiple directions in the extended reality world. As shown in the example of FIG. 8, audio stream 802 may be a spherical audio stream in a B-format ambisonic format that includes elements associated with the x, y, z, and w components of coordinate system 504 described above. As mentioned above, even if audio data 410 carries the audio represented in an audio stream in another format (e.g., a monaural format, a stereo format, an ambisonic A-format, etc.), system 100 may be configured to convert the signal from the other format to the spherical B-format of audio stream 802 shown in FIG. 8.

Impulse response 804 may represent any impulse response or combination of impulse responses selected from impulse response library 412 in the ways described herein. As shown, impulse response 804 is a spherical impulse response that, like audio stream 802, includes components associated with each of x, y, z, and w components of coordinate system 504. System 100 may apply spherical impulse response 804 to spherical audio stream 802 to imbue audio stream 802 with reverberation effects and other environmental acoustics associated with the one or more impulse responses that have been selected from the impulse response library. As described above, one impulse response 804 may smoothly transition or crossfade to another impulse response 804 as user 202 moves within world 200 from one subspace 302 to another.

Impulse response 804 may be generated or synthesized in any of the ways described herein, including by combining elements from a plurality of selected impulse responses in scenarios such as those described above in which the listener or sound source location is near a subspace boundary, or multiple sound sources exist. Impulse responses may be combined to form impulse response 804 in any suitable way. For instance, multiple spherical impulse responses may be synthesized together to form a single spherical impulse response used as the impulse response 804 that is applied to audio stream 802. In other examples, averaging (e.g., weighted averaging) techniques may be employed in which respective portions from each of several impulse responses for a given component of the coordinate system are averaged. In still other examples, each of multiple spherical impulse responses may be individually applied to dry audio stream 802 (e.g., by way of separate convolution operations 806) to form a plurality of different wet audio streams 808 that may be mixed, averaged, or otherwise combined after the fact.

Convolution operation 806 may represent any mathematical operation by way of which impulse response 804 is applied to dry audio stream 802 to form wet audio stream 808. For example, convolution operation 806 may use convolution reverb techniques to apply a given impulse response 804 and/or to crossfade from one impulse response 804 to another in a continuous and natural-sounding manner. As shown, when convolution operation 806 is used to apply a spherical impulse response to a spherical audio stream (e.g., impulse response 804 to audio stream 802), a spherical audio stream (e.g., wet audio stream 808) results that also includes different components for each of the x, y, z, and w coordinate system components. In some examples, it will be understood that non-spherical impulse responses may be applied to non-spherical audio streams using a convolution operation similar to convolution operation 806. For example, the input and output of convolution operation 806 could be monaural, stereo, or another suitable format. Such non-spherical signals, together with additional spherical signals and/or any other signals being processed in parallel with audio stream 808 within system 100 may be represented in FIG. 8 by other audio signals 810. Additionally, other audio streams represented by audio data 410 may be understood to be included within other audio signals 810.

As shown, mixer 812 is configured to combine the wet audio stream 808 with the dry audio stream 802, as well as any other audio signals 810 that may be available in a given example. Mixer 812 may be configurable to deliver any amount of wet or dry signal in the final mixed signal as may be desired by a given user or for a given use scenario. For instance, if mixer 812 relies heavily on wet audio stream 808, the reverberation and other acoustic effects of impulse response 804 will be very pronounced and easy to hear in the final mix. Conversely, if mixer 812 relies heavily on dry audio stream 802, the reverberation and other acoustic effects of impulse response 804 will be less pronounced and more subtle in the final mix. Mixer 812 may also be configured to convert incoming signals (e.g., wet and dry audio streams 808 and 802, other audio signals 810, etc.) to different formats as may serve a particular application. For example, mixer 812 may convert non-spherical signals to spherical formats (e.g., ambisonic formats such as the B-format) or may convert spherical signals to non-spherical formats (e.g., stereo formats, surround sound formats, etc.) as may serve a particular implementation.

Binaural renderer 814 may receive an audio stream (e.g., a mix of the wet and dry audio streams 808 and 802 described above) together with, in certain examples, one or more other audio signals 810 that may be spherical or any other suitable format. Additionally, binaural renderer 814 may receive (e.g., from media player device 204) acoustic propagation data 816 indicative of an orientation of a head of avatar 202. Binaural renderer 814 generates audio stream 414 as a binaural audio stream using the input audio streams from mixer 812 and other audio signals 810 and based on acoustic propagation data 816. More specifically, for example, binaural renderer 814 may convert the audio streams received from mixer 812 and/or other audio signals 810 into a binaural audio stream that includes proper sound for each ear of user 202 based on the direction that the head of avatar 202 is facing within world 200. As with mixer 802, signal processing performed by binaural renderer 814 may include converting to and from different formats (e.g., converting a non-spherical signal to a spherical format, converting a spherical signal to a non-spherical format, etc.). The binaural audio stream generated by binaural renderer 814 may be provided to media player device 204 as audio stream 414, and may be configured to be presented to user 202 by media player device 204 (e.g., by audio rendering system 204-2 of media player device 204). In this way, sound presented by media player device 204 to user 202 may be presented in accordance with the simulated acoustics customized to the identified location of avatar 202 in world 200, as has been described.

Figure 9:
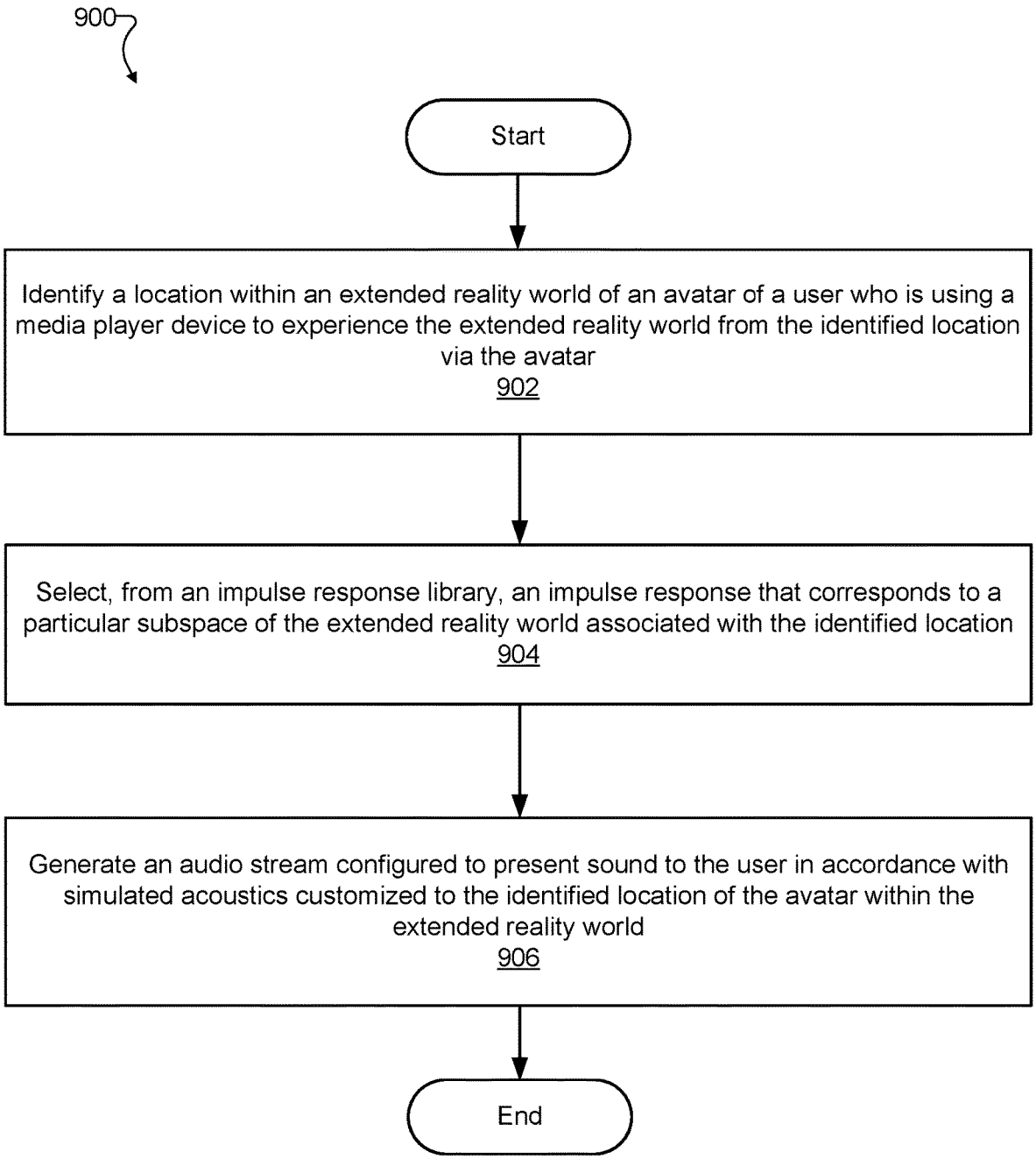
FIGS. 9 and 10 illustrate exemplary methods for simulating spatially-varying acoustics of an extended reality world according to embodiments described herein.

FIG. 9 illustrates an exemplary method 900 for simulating spatially-varying acoustics of an extended reality world. While FIG. 9 illustrates exemplary operations according to one embodiment, other embodiments may omit, add to, reorder, and/or modify any of the operations shown in FIG. 9. One or more of the operations shown in FIG. 9 may be performed by an acoustics simulation system such as system 100, any components included therein, and/or any implementation thereof.

In operation 902, an acoustics simulation system may identify a location within an extended reality world. For example, the location identified by the acoustics simulation system may be a location of an avatar of a user who is using a media player device to experience, via the avatar, the extended reality world from the identified location. Operation 902 may be performed in any of the ways described herein.

In operation 904, the acoustics simulation system may select an impulse response from an impulse response library. For example, the impulse response library may include a plurality of different impulse responses each corresponding to a different subspace of the extended reality world, and the selected impulse response may correspond to a particular subspace of the different subspaces of the extended reality world. More particularly, the particular subspace to which the selected impulse response corresponds may be associated with the identified location. Operation 904 may be performed in any of the ways described herein.

In operation 906, the acoustics simulation system may generate an audio stream based on the impulse response selected at operation 904. For example, the generated audio stream may be configured, when rendered by the media player device, to present sound to the user in accordance with simulated acoustics customized to the identified location of the avatar within the extended reality world. Operation 906 may be performed in any of the ways described herein.

Figure 10:
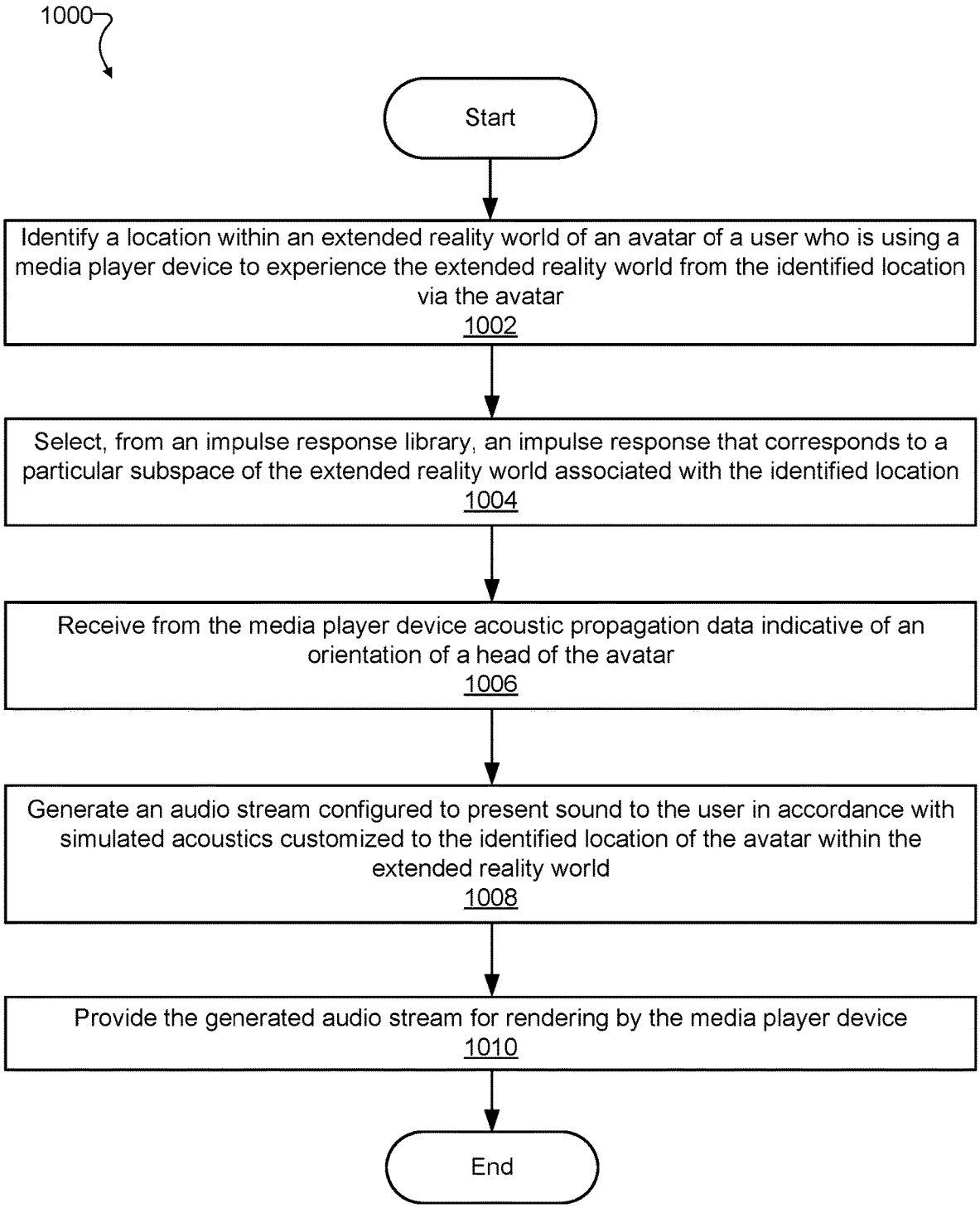

FIG. 10 illustrates an exemplary method 1000 for simulating spatially-varying acoustics of an extended reality world. As with FIG. 9, while FIG. 10 illustrates exemplary operations according to one embodiment, other embodiments may omit, add to, reorder, and/or modify any of the operations shown in FIG. 10. One or more of the operations shown in FIG. 10 may be performed by an acoustics simulation system such as system 100, any components included therein, and/or any implementation thereof. In some examples, the operations of method 1000 may be performed by a multi-access edge compute server such as MEC server 408 that is associated with a provider network providing network service to a media player device used by a user to experience an extended reality world.

In operation 1002, an acoustics simulation system implemented by a MEC server may identify a location within an extended reality world. For instance, the location identified by the acoustics simulation system may be a location of an avatar of a user as the user uses a media player device to experience, via the avatar, the extended reality world from the identified location. Operation 1002 may be performed in any of the ways described herein.

In operation 1004, the acoustics simulation system may select an impulse response from an impulse response library. The impulse response library may include a plurality of different impulse responses each corresponding to a different subspace of the extended reality world, and the selected impulse response may correspond to a particular subspace of the different subspaces of the extended reality world that is associated with the identified location. Operation 1004 may be performed in any of the ways described herein.

In operation 1006, the acoustics simulation system may receive acoustic propagation data. For instance, the acoustic propagation data may be received from the media player device. In some examples, the received acoustic propagation data may be indicative of an orientation of a head of the avatar. Operation 1006 may be performed in any of the ways described herein.

In operation 1008, the acoustics simulation system may generate an audio stream based on the impulse response selected at operation 1004 and the acoustic propagation data received at operation 1006. The audio stream may be configured, when rendered by the media player device, to present sound to the user in accordance with simulated acoustics customized to the identified location of the avatar within the extended reality world. Operation 1008 may be performed in any of the ways described herein.

In operation 1010, the acoustics simulation system may provide the audio stream generated at operation 1008 to the media player device for rendering by the media player device. Operation 1010 may be performed in any of the ways described herein.

In some examples, a non-transitory computer-readable medium storing computer-readable instructions may be provided in accordance with the principles described herein. The instructions, when executed by a processor of a computing device, may direct the processor and/or computing device to perform one or more operations, including one or more of the operations described herein. Such instructions may be stored and/or transmitted using any of a variety of known computer-readable media.

A non-transitory computer-readable medium as referred to herein may include any non-transitory storage medium that participates in providing data (e.g., instructions) that may be read and/or executed by a computing device (e.g., by a processor of a computing device). For example, a non-transitory computer-readable medium may include, but is not limited to, any combination of non-volatile storage media and/or volatile storage media. Exemplary non-volatile storage media include, but are not limited to, read-only memory, flash memory, a solid-state drive, a magnetic storage device (e.g. a hard disk, a floppy disk, magnetic tape, etc.), ferroelectric random-access memory ("RAM"), and an optical disc (e.g., a compact disc, a digital video disc, a Blu-ray disc, etc.). Exemplary volatile storage media include, but are not limited to, RAM (e.g., dynamic RAM).

Figure 11:
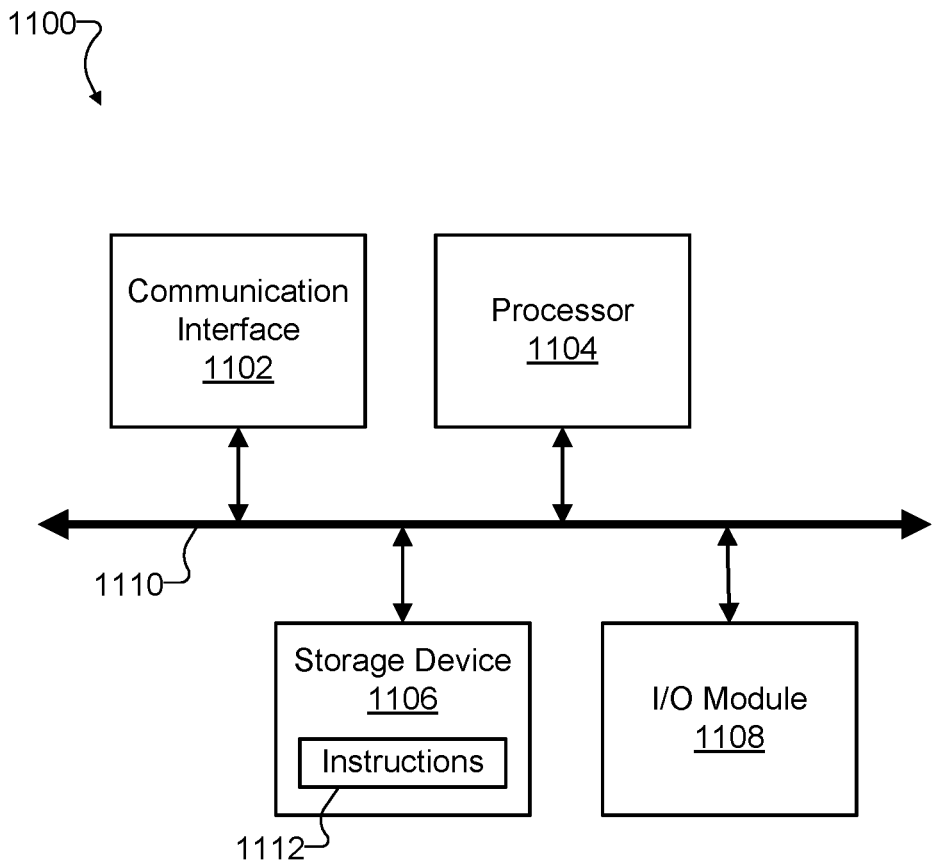
FIG. 11 illustrates an exemplary computing device according to principles described herein.

FIG. 11 illustrates an exemplary computing device 1100 that may be specifically configured to perform one or more of the operations described herein. For example, computing device 1100 may implement an acoustics simulation system such as system 100, an implementation thereof, or any other system or device described herein (e.g., a MEC server such as MEC server 408, a media player device such as media player device 204, other systems such as provider system 402, or the like).

As shown in FIG. 11, computing device 1100 may include a communication interface 1102, a processor 1104, a storage device 1106, and an input/output ("I/O") module 1108 communicatively connected one to another via a communication infrastructure 1110. While an exemplary computing device 1100 is shown in FIG. 11, the components illustrated in FIG. 11 are not intended to be limiting. Additional or alternative components may be used in other embodiments. Components of computing device 1100 shown in FIG. 11 will now be described in additional detail.

Communication interface 1102 may be configured to communicate with one or more computing devices. Examples of communication interface 1102 include, without limitation, a wired network interface (such as a network interface card), a wireless network interface (such as a wireless network interface card), a modem, an audio/video connection, and any other suitable interface.

Processor 1104 generally represents any type or form of processing unit capable of processing data and/or interpreting, executing, and/or directing execution of one or more of the instructions, processes, and/or operations described herein. Processor 1104 may perform operations by executing computer-executable instructions 1112 (e.g., an application, software, code, and/or other executable data instance) stored in storage device 1106.

Storage device 1106 may include one or more data storage media, devices, or configurations and may employ any type, form, and combination of data storage media and/or device. For example, storage device 1106 may include, but is not limited to, any combination of the non-volatile media and/or volatile media described herein. Electronic data, including data described herein, may be temporarily and/or permanently stored in storage device 1106. For example, data representative of computer-executable instructions 1112 configured to direct processor 1104 to perform any of the operations described herein may be stored within storage device 1106. In some examples, data may be arranged in one or more databases residing within storage device 1106.

I/O module 1108 may include one or more I/O modules configured to receive user input and provide user output. I/O module 1108 may include any hardware, firmware, software, or combination thereof supportive of input and output capabilities. For example, I/O module 1108 may include hardware and/or software for capturing user input, including, but not limited to, a keyboard or keypad, a touchscreen component (e.g., touchscreen display), a receiver (e.g., an RF or infrared receiver), motion sensors, and/or one or more input buttons.

I/O module 1108 may include one or more devices for presenting output to a user, including, but not limited to, a graphics engine, a display (e.g., a display screen), one or more output drivers (e.g., display drivers), one or more audio speakers, and one or more audio drivers. In certain embodiments, I/O module 1108 is configured to provide graphical data to a display for presentation to a user. The graphical data may be representative of one or more graphical user interfaces and/or any other graphical content as may serve a particular implementation.

In some examples, any of the facilities described herein may be implemented by or within one or more components of computing device 1100. For example, one or more applications 1112 residing within storage device 1106 may be configured to direct processor 1104 to perform one or more processes or functions associated with processing facility 104 of system 100. Likewise, storage facility 102 of system 100 may be implemented by or within storage device 1106.

To the extent the aforementioned embodiments collect, store, and/or employ personal information provided by individuals, it should be understood that such information shall be used in accordance with all applicable laws concerning protection of personal information. Additionally, the collection, storage, and use of such information may be subject to consent of the individual to such activity, for example, through well known "opt-in" or "opt-out" processes as may be appropriate for the situation and type of information. Storage and use of personal information may be in an appropriately secure manner reflective of the type of information, for example, through various encryption and anonymization techniques for particularly sensitive information.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A method comprising:

selecting, by an acoustics simulation system from an impulse response library, au impulse response that corresponds to a subspace of an extended reality world;

generating, by the acoustics simulation system based on the selected impulse response, audio data customized to the subspace of the extended reality world; and providing, by the acoustics simulation system, the generated audio data for simulating acoustics of the extended reality world as part of a presentation of the extended reality world.

2. The method of claim 1, further comprising identifying, by the acoustics simulation system, a location, within the extended reality world, of an avatar of a user who is using a media player device to experience, via the avatar, the extended reality world from the identified location;

wherein the providing of the generated audio data includes streaming, to the media player device as the user is experiencing the extended reality world, the generated audio data as an audio stream.

3. The method of claim 2, wherein the audio stream is configured, when rendered by the media player device, to present sound to the user in accordance with simulated acoustics customized to the identified location of the avatar within the extended reality world.

4. The method of claim 2, further comprising receiving, by the acoustics simulation system from the media player device, acoustic propagation data indicative of an orientation of a head of the avatar;

wherein the generating of the audio data is further based on the acoustic propagation data indicative of the orientation of the head.

5. The method of claim 2, wherein:

the identified location of the avatar within the extended reality world is proximate a boundary between the subspace and an additional subspace within the extended reality world:

the method further comprises selecting, by the acoustics simulation system together with the selecting of the impulse response, an additional impulse response that corresponds to the additional subspace; and the generating of the audio data is performed further based on the additional impulse response.

6. The method of claim 1, wherein:

the subspace of the extended reality world corresponds to a listener location, within the extended reality world, of an avatar of a user experiencing the extended reality world via the avatar from the listener location; and the impulse response selected from the impulse response library further corresponds to an additional subspace of the extended reality world, the additional subspace corresponding to a potential sound source location within the extended reality world.

7. The method of claim 1, further comprising:

identifying, by the acoustics simulation system within the extended reality world, a first location where a first sound source originates virtual sound that is to propagate through the extended reality world to an avatar at a listener location within the extended reality world;

identifying, by the acoustics simulation system within the extended reality world, a second location where a second sound source originates virtual sound that is to propagate through the extended reality world to the avatar, and selecting, by the acoustics simulation system, an additional impulse response that corresponds to the subspace of the extended reality world:

wherein:

the impulse response further corresponds to a first additional subspace associated with the first location where the first sound source originates the virtual sound, the additional impulse response further corresponds to a second additional subspace associated with the second location where the second sound source originates the virtual sound, and the generating of the audio data is performed further based on the additional impulse response.

8. The method of claim 1, Wherein:

the impulse response library includes a plurality of different impulse responses each corresponding to a different subspace of a plurality of subspaces included within the extended reality world;

the plurality of different impulse responses includes the impulse response; and the plurality of subspaces included within the extended reality world includes the subspace to which the impulse response corresponds.

9. The method of claim 1, wherein:

the extended reality world is implemented by a virtual, augmented, or mixed-reality world that is based on a real-world scene that has been captured or is being captured by a real-world video camera; and each impulse response included within the impulse response library is defined prior to the selecting of the impulse response by recording the impulse response using a microphone placed at the real-world scene.

10. The method of claim 1, wherein:

the extended reality world is implemented by a computer-generated virtual world; and each impulse response included within the impulse response library is defined prior to the selecting of the impulse response by synthesizing the impulse response based on simulated acoustic characteristics of the computer-generated virtual world.

11. A system comprising:

a memory storing instructions; and a processor communicatively coupled to the memory and configured to execute the instructions to:

select, from an impulse response library, an impulse response that corresponds to a subspace of an extended reality world;

generate, based on the selected impulse response, audio data customized to the subspace of the extended reality world; and provide the generated audio data for simulating acoustics of the extended reality world as part of a presentation of the extended reality world.

12. The system of claim 11, wherein:

the processor is further configured to execute the instructions to identify a location, within the extended reality world, of an avatar of a user who is using a media player device to experience, via the avatar, the extended reality world from the identified location; and the providing of the generated audio data includes streaming, to the media player device as the user is experiencing the extended reality world, the generated audio data as an audio stream.

13. The system of claim 12, wherein the audio stream is configured, when rendered by the media player device, to present sound to the user in accordance with simulated acoustics customized to the identified location of the avatar within the extended reality world.

14. The system of claim 12, wherein:

the processor is further configured to execute the instructions to receive, from the media player device, acoustic propagation data indicative of an orientation of a head of the avatar, and the generating of the audio data is further based on the acoustic propagation data indicative of the orientation of the head.

15. The system of claim 12, wherein:

the identified location of the avatar within the extended reality world is proximate a boundary between the subspace and an additional subspace within the extended reality world;

the processor is further configured to execute the instructions to select, together with the selecting of the impulse response, an additional impulse response that corresponds to the additional subspace; and the generating of the audio data is performed further based on the additional impulse response.

16. The system of claim 11, wherein:

the subspace of the extended reality world corresponds to a listener location, within the extended reality world, of an avatar of a user experiencing the extended reality world via the avatar from the listener location; and the impulse response selected from the impulse response library further corresponds to an additional subspace of the extended reality world, the additional subspace corresponding to a potential sound source location within the extended reality world.

17. The system of claim 11, wherein the processor is further configured to execute the instructions to:

identify, within the extended reality world, a first location where a first sound source originates virtual sound that is to propagate through the extended reality world to an avatar at a listener location within the extended reality world:

identify, within the extended reality world, a second location where a second sound source originates virtual sound that is to propagate through the extended reality world to the avatar; and select an additional impulse response that corresponds to the subspace of the extended reality world:

wherein:

the impulse response further corresponds to a first additional subspace associated with the first location where the first sound source originates the virtual sound, the additional impulse response further corresponds to a second additional subspace associated with the second location where the second sound source originates the virtual sound, and the generating of the audio data is performed further based on the additional impulse response.

18. The system of claim 11, wherein:

the impulse response library includes a plurality of different impulse responses each corresponding to a different subspace of a plurality of subspaces included within the extended reality world;

the plurality of different impulse responses includes the impulse response; and the plurality of subspaces included within the extended reality world includes the subspace to which the impulse response corresponds.

19. The system of claim 11, wherein the processor is part of a multi-access edge compute server associated with a provider network that provides network service to a media player device used by a user.

20. A non-transitory computer-readable medium storing instructions that, when executed, direct a processor of a computing device to:

select, from an impulse response library, an impulse response drat corresponds to a subspace of an extended reality world;

generate, based on the selected impulse response, audio data customized to the subspace of the extended reality world; and provide the generated audio data for simulating acoustics of the extended reality world as part of a presentation of the extended reality world.

* * * * *